US006578225B2

(12) United States Patent
Jönsson

(10) Patent No.: US 6,578,225 B2
(45) Date of Patent: Jun. 17, 2003

(54) LOW-SPEED PREBALANCING FOR WASHING MACHINES

(75) Inventor: Joakim Jönsson, Hisings-Backa (SE)

(73) Assignee: SKF AutoBalance Systems AB, Gothenburg (SE)

( * ) Notice: Subject to any disclaimer, the term of this patent is extended or adjusted under 35 U.S.C. 154(b) by 21 days.

(21) Appl. No.: 09/863,270

(22) Filed: May 24, 2001

(65) Prior Publication Data

US 2002/0016997 A1 Feb. 14, 2002

Related U.S. Application Data

(60) Provisional application No. 60/206,987, filed on May 25, 2000.

(51) Int. Cl.[7] ..... D06F 37/20

(52) U.S. Cl. ..... 8/159; 68/12.02; 68/12.06; 68/12.12

(58) Field of Search ..... 68/12.01, 12.02, 68/12.06, 12.16, 12.17, 12.19, 12.12; 8/158, 159

(56) References Cited

U.S. PATENT DOCUMENTS

| | | | | |
|---|---|---|---|---|
| 2,461,643 | A | * | 2/1949 | Hemmeter |
| 2,534,269 | A | * | 12/1950 | Kahan et al. |
| 2,911,812 | A | * | 11/1959 | Metzger |
| 2,950,009 | A | * | 8/1960 | Bochan |
| 2,984,094 | A | | 5/1961 | Belaieff |
| 3,258,124 | A | * | 6/1966 | Cobb et al. |
| 3,640,098 | A | * | 2/1972 | Eastall |
| 4,433,592 | A | | 2/1984 | Tatsumi et al. |
| 4,513,464 | A | * | 4/1985 | Rittich et al. |
| 4,765,161 | A | * | 8/1988 | Williamson |
| 5,115,651 | A | * | 5/1992 | Nukaga et al. |
| 5,345,792 | A | | 9/1994 | Farrington et al. |
| 5,548,979 | A | | 8/1996 | Ryan et al. |
| 5,561,993 | A | | 10/1996 | Elgersma et al. |
| 5,692,313 | A | | 12/1997 | Ikeda et al. |
| 5,752,397 | A | * | 5/1998 | Bruntz |
| 5,850,748 | A | | 12/1998 | Kim et al. |
| 5,862,553 | A | * | 1/1999 | Habel et al. |
| 6,029,300 | A | | 2/2000 | Kawaguchi et al. |
| 6,401,284 | B1 | * | 6/2002 | Jeon et al. |

FOREIGN PATENT DOCUMENTS

| | | | |
|---|---|---|---|
| DE | 3145588 | * | 5/1983 |
| DE | 3933355 | * | 5/1990 |
| EP | 0 878 575 A1 | | 11/1978 |
| EP | 0 792 963 A2 | | 9/1997 |
| EP | 999300 | | 10/1999 |
| JP | 62-167589 | * | 7/1987 |
| JP | 3-86197 | * | 4/1991 |
| JP | 3-261500 | * | 11/1991 |

* cited by examiner

*Primary Examiner*—Frankie L. Stinson
(74) *Attorney, Agent, or Firm*—Burns, Doane, Swecker & Mathis, LLP

(57) ABSTRACT

A horizontally oriented laundry washing machine which includes automatic balancers is operated at a speed below the stick speed for the laundry load to redistribute portions of the load in the wash basket. By monitoring a condition of the machine indicative of the level of balance of the load, and selectively accelerating and decelerating the wash basket about the stick speed, the load can be redistributed so that the load imbalance is sufficient low to speed up the wash basket through its natural resonant frequencies.

22 Claims, 13 Drawing Sheets

3.5kg IEC washload

3.5kg IEC washload

Wash Basket Speed-Time History During Prebalancing at Speeds Near the Stickspeed Prebalancing Time History Prebalancing at a speed near the stickspeed

LOW-SPEED PREBALANCING FOR WASHING MACHINES

This application is related and claims priority under 35 U.S.C. §119 to U.S. application Ser. No. 60/206,987, filed May 25, 2000, the entire contents of which are incorporated by reference herein.

BACKGROUND OF THE INVENTION

1. Field of the Invention

The invention relates to pre-balancing methods and apparatus, and in particular to pre-balancing methods and apparatus useful for domestic and commercial washing machines.

2. Brief Description of the Related Art

The need for balancing of washing machine baskets is well known. In a typical washing machine, upon the completion of the wash cycle, the excess water is extracted from clothes during the so-called spin cycle. During a spin cycle, the clothes held in the wash basket are rotated at high speeds. The excess water, acted upon by the centrifugal forces generated by this spinning, is forced out of the clothes and to the outside of the wash basket, where it forced out through the perforations in the walls of the wash basket and into the drain. An efficient water extraction from the clothes is beneficial as it reduces the drying times for clothes.

The efficiency of the water extraction depends on the spin speeds. It is a well-known fact that the higher the spin speed, the higher the water extraction. It is therefore beneficial to afford high spin speeds in washing machines. However, high spin speeds give rise to high levels of vibration caused by imbalances in the wash basket due to uneven distribution of clothes during spinning. Such imbalances randomly change from one wash to the next and their exact magnitudes and locations relative to wash baskets are not known prior to spinning. The difficulty in dealing with such imbalances is further exacerbated by the fact that as the process of water extraction takes place during the spinning operation, the imbalances change. The problem of imbalance and vibration during spinning is undesirable due to stress and damage to the machine and its various components. Furthermore, excessive vibration during the spinning can adversely affect the efficiency of water extraction, result in unwanted noise, and in some cases, cause damage to the sub-floor.

A number techniques have been proposed to deal with the problem of imbalance in wash baskets. The most commonly used technique relies on attaching heavy counterweights to the outer tub, which houses the rotating wash basket. Such counter-weights are typically made of steel, concrete, or some other heavy material, and are intended to reduce vibration by increasing the weight of the suspended assembly. The main disadvantages of such a technique are the increased weight and cost of the machine, as well as the fact that the rotating components are still subjected to the same damaging stresses due to imbalance.

Various alternate techniques have been proposed that counteract the unknown and changing imbalances in wash baskets of washing machines. These techniques are based on the concept of the so-called automatic balancing. Herein, the balancing is achieved by operably mounting an apparatus on the rotating member, which includes an annular cavity containing a balancing fluid or a plurality of movable masses. As sufficient rotational speeds of the rotating member are reached, the balancing fluid or the movable masses position themselves as to counteract the imbalance of the rotating member. One such apparatus is described in U.S. Pat. No. 4,433,592 (Tatsumi et al.). Tatsumi et al. describe a vertical axis washing machine including a wash basket rotatable about its axis of rotation and operably mounted inside the outer tub. The apparatus further includes an annular groove or a race provided in the top plane of the wash basket containing a plurality of freely movable counterbalancing weights. As the wash basket reaches its spin speed, the counterbalancing weights position themselves as to counteract any imbalances in the wash basket.

A similar type of structure is described in the U.S. Pat. No. 2,984,094 (Balaieff). Balaieff describes a front loading, horizontal axis washing machine assembly having annular races or grooves placed at each end and at the outer periphery of the rotating wash basket and concentric with its axis of rotation. The apparatus further includes pluralities of freely movable balls disposed in each of the annular grooves. During the operation of the rotating member, such balls position themselves so as to compensate for any unbalanced static and dynamic loads.

Another type of apparatus is described in U.S. Pat. No. 5,448,979 (Ryan et al.). Ryan et al. describe a wash basket with two balancing rings including annular grooves partially filled with a balancing fluid, such as water. The annular grooves are placed at the opposite ends of the wash basket. During operation, the balancing fluid flows into the direction so as to counteract the imbalance forces.

Further, a similar structure is described in U.S. Pat. No. 5,345,792 (Farrington et al.). This document describes an apparatus including a plurality of annular grooves disposed at each end of the wash basket and containing pluralities of balancing fluids.

Yet further types of apparatus are described in U.S. Pat. No. 5,850,748 (Kim et al.). Kim et al. describes a wash basket of a front loading horizontal axis washing machine including two concentric annular races placed at each end of the wash basket, each pair of annular races containing compensating weights of different size with the inner races having smaller weights than the outer races.

Such prior devices provide compensation for imbalance at the spin speeds; however, these devices have certain disadvantages. It is well known to those skilled in the art that automatic balancers counteract the imbalance forces in rotating members at speeds which are above the so-called resonant or critical speed of the suspended assembly. In typical washing machines, and indeed in most washing machines, such critical speeds are lower than the design spin speeds of rotation of the wash baskets. Therefore, automatic balancers, such as those described in the above prior documents, are able counteract the imbalances at spin speeds. However, automatic balancers are ineffective for rotating speeds below the critical speeds and actually can add to the imbalance forces. A consequence of this limitation is that during the entire time that the wash basket is accelerated from its initial position of rest to the operating speed, the wash basket remains severely unbalanced. Furthermore, upon start-up, as the speed of rotation approaches the critical speed of the suspended wash assembly, violent resonant oscillations occur resulting in the assembly often hitting the cabinet of the washing machine. In fact, it has been observed that such resonances are often more severe in cases when automatic balancers are deployed. Correspondingly, heavy counterweights must be utilized to control such resonances and on occasion larger washing machine cabinets are required. This, in turn, results in higher cost of the machine, higher transportation costs, and inconvenience to the end user.

Furthermore, most modem machines come equipped with imbalance sensors and/or trip switches to protect the fragile electronic systems. Therein, if sufficiently large imbalances, or excessive vibration levels during start-up, are detected, the washing machine will not begin the spin cycle. As a result, water extraction will not take place until the user manually rearranges the wet laundry inside the wash basket. Herein lies a significant disadvantage of the above prior devices. Since imbalance detection takes place at low speeds, which are below the resonant speeds, greater imbalances will typically be sensed with automatic balancers. Similarly, as the machine accelerates through its resonant speed, higher levels or resonant vibrations will typically result with automatic balancers. Consequently, such systems can be detrimental to the proper engagement of spin cycles.

One solution to overcome the disadvantages of the above prior art is through so-called pre-balancing. It is known to those skilled in the art that some type of pre-balancing of the wash loads is required prior to engaging the spin cycle, regardless of whether the machine is equipped with automatic balancers or not. Pre-balancing refers to a process or a procedure wherein a balanced or partially balanced condition for the wash basket is achieved at low speeds (i.e., below the resonant speeds) of rotation prior to accelerating to desired spin speeds.

Conventional methods of achieving such pre-balancing rely upon a variety of tumbling motions preceding the attempts of engaging the spin cycles. Such tumbling motions are aimed at redistributing the wash load and are often accompanied by periodic additions of water. The disadvantages of such methods are well known to those skilled in the art. Notable among the disadvantages, such methods do not eliminate the need for heavy counter-weights. These prior methods are based on predefined sequences of movements resulting in substantially random changes to the distribution of clothes. Also, since there are no external aids to the pre-balancing process, the process is, in general, unreliable, and hence, the use of heavy counterweights cannot be avoided. Another disadvantage of such methods lies in increased water usage, which creates waste. Yet another disadvantage is associated with occasionally long pre-balancing times before an acceptable level of residual imbalance is sensed.

A different type of method for achieving pre-balancing is described in U.S. Pat. No. 5,862,553 (Haberl et al.). Haberl et al. describes a clothes washing machine apparatus equipped with automatic balancing devices. The balancing devices include a plurality of annular races (hollow members) mounted onto the wash basket (rotating tub), within which races pluralities of freely movable masses are disposed. Additionally, a damping fluid is disposed in each of the hollow members. The apparatus further includes devices which rotate the wash basket at various speeds of rotation and means which sense the acceleration and frequency of rotation. Haberl et al. describes that before at least one spin extraction phase, the drum is rotated at a relatively low speed until the compensating masses position themselves substantially so as to counteract the imbalances of the wash load. Such relatively low speeds are, according to Haberl et al, lower than the resonant speeds of the suspended assembly but sufficiently high to cause the wash load items to adhere to the wash basket.

The apparatus described by Haberl et al. relies primarily on fluctuations in the speed of rotation of the drum over each revolution and the viscous dragging action imparted on the compensating masses by the damping fluid during the low speed rotation. Haberl et al. describe that the fluctuations in the speed of the drum are caused by a wash load imbalance acted on by the force of gravity. During low speed rotation, as the imbalance mass is carried upward, the rotational speed of the drum decreases from its mean value due to the opposing action of the gravity force. Subsequently, as the imbalance mass is rotated in a downward direction, the gravity force assists in the rotation and the drum accelerates. Similarly, the movement of the compensating masses relative to the rotating drum fluctuates. As the compensating masses are rotated upward from their low position by the dragging action of the viscous fluid, the gravity forces oppose such movement which prevents the compensating masses from moving together with the rotating drum and causes them to fall behind. The compensating masses continue to fall behind in their movement relative to the rotation of the drum until they reach the top position, as which point the force of gravity begins to assist in their movement.

Haberl et al. describes that such fluctuations of the rotating movement of the drum in combination with the fluctuations in the movement of the compensating masses result in the compensating masses positioning themselves substantially in opposition to the wash load imbalance, and thus self-balancing the rotating drum. Haberl et al. indicate that through proper selection of the key parameters, such as the mean speed of rotation and the viscosity of the fluid, a self-balancing action for the rotating drum can be achieved at low speeds of rotation through the interaction of the above-described motions.

The apparatus of Haberl et al. has, however, some disadvantages. One of the disadvantages is that the proposed solution takes into account the forces caused by the rotational speed variations of the drum. It has been found experimentally that this is only correct under specific circumstances where, among other things, the movements of the entire suspended assembly during the low speed rotation are sufficiently small so as not to impact the desired variations of the aforementioned motion for the rotating drum and compensation masses.

Yet another disadvantage of the device of Haberl et al. lies in the fact that the key parameters, i.e., mean speed and viscosity of the damping fluid, are chosen to provide the optimum performance for some predefined and anticipated typical imbalance condition. Since in actual operation the imbalance condition will vary and, with it, the fluctuations in the rotating velocity of the drum, self-balancing performance will generally deviate from the optimal. Additionally, depending on the particular wash cycle (which is not known in advance), the temperature of the damping fluid will vary. This will affect the fluid's viscosity, which in turn will cause the movement of compensating masses to deviate from the desired one. In all, such variations in operating conditions will negatively impact the self-balancing action of the rotating drum.

Yet a further disadvantage of the above prior approaches originates from the fact that the low speed balancing (self-balancing) is performed above stick-speeds, i.e., speeds which are sufficiently high to ensure the wash load adheres to the wash basket at all times. It has been found experimentally that on most domestic and commercial machines stick speeds are too high for quick, accurate, and reliable self-balancing action. Moreover, such stick speeds are high enough to cause considerable movements in the suspended assembly due to rotating motion of the wash basket, which in turn, further impacts the self-balancing action.

It has also been found that the above disadvantages often result in long pre-balancing times, i.e., time intervals required to achieve sufficiently good balance of the wash basket. Long pre-balancing times, however, give rise to the onset of unwanted "dynamic imbalances" which originate within the balancers themselves. This is particularly true when the amount of actual imbalance is considerably lower than the balancing capacity of the balancers. Herein, although in a static sense, the balancers at either end of the wash basket substantially counteract the wash load imbalance, the compensating masses in the two units, or certain amounts thereof, are in effect opposite to each other. This gives rise to dynamic imbalance (or the so-called imbalance couple) and causes violent resonant rocking mode vibration when the wash basket is accelerated during the spin extraction phase.

A structure and a method similar to those in Haberl et al, is described in SE 9803567-8. However, most of disadvantages of the Haberl devices are also present in this latter disclosure.

SUMMARY OF THE INVENTION

One aspect of the present invention relates to a method for reducing an out-of-balance condition during the low speed rotation of the wash basket of a laundry clothes washing machine, the machine including a cabinet frame, an outer tub, springs and dampers resiliently supporting the outer tub in the cabinet frame, a wash basket rotatably positioned inside the outer tub and capable of rotating about an axis of rotation, and means for rotating the wash basket at different speeds of rotation about the axis of rotation, two automatic balancers attached to the wash basket at each end of the wash basket, the automatic balancers having an axis of rotation substantially coincident with the axis of rotation of the wash basket, means for detecting a condition indicative of imbalance of a load in the wash basket at low speeds of rotation, the method comprising the steps of accelerating the wash basket to first speed of rotation, said first speed of rotation being below a resonant speed of the supported assembly of the washing machine and higher than a speed at which any wash load movements inside the wash basket occur, decelerating from the first speed of rotation to a second speed of rotation, the second speed of rotation being lower than the first speed of rotation, the second speed of rotation being sufficiently low to initiate the movement of the wash load in the wash basket, and continuing the wash basket rotation at speeds lower than the second speed of rotation until movements of the wash load and the action of the automatic balancers impart a dynamic balancing condition which reduces the out-of-balance condition of the rotating wash basket below a predetermined level.

Another aspect of the present invention relates to a washing machine useful for reducing an out-of-balance condition thereof, the machine comprising a cabinet frame, an outer tub, springs and dampers resiliently supporting the outer tub in the cabinet frame, a wash basket rotatably positioned inside the outer tub and capable of rotating about an axis of rotation, two automatic balancers attached to the wash basket at each end of the wash basket, the automatic balancers having an axis of rotation substantially coincident with the axis of rotation of the wash basket, means for detecting a condition indicative of imbalance of a load in the wash basket at low speeds of rotation, and means for controlling the velocity of the wash basket including means for rotating the wash basket at different speeds of rotation about the axis of rotation, logic for accelerating the wash basket to first speed of rotation, said first speed of rotation being below a resonant speed of the supported assembly of the washing machine and higher than a speed at which any wash load movements inside the wash basket occur, logic for decelerating from the first speed of rotation to a second speed of rotation, the second speed of rotation being lower than the first speed of rotation, the second speed of rotation being sufficiently low to initiate the movement of the wash load in the wash basket, and logic for continuing the wash basket rotation at speeds lower than the second speed of rotation until movements of the wash load and the action of the automatic balancers impart a dynamic balancing condition which reduces the out-of-balance condition of the rotating wash basket below a predetermined level.

Yet another aspect of the present invention relates to a method for reducing an out-of-balance condition during the low speed rotation of the wash basket of a laundry clothes washing machine, the machine including a cabinet frame, an outer tub, springs and dampers resiliently supporting the outer tub in the cabinet frame, a wash basket rotatably positioned inside the outer tub and capable of rotating about an axis of rotation, and means for rotating the wash basket at different speeds of rotation about the axis of rotation, two automatic balancers attached to the wash basket at each end of the wash basket, the automatic balancers having an axis of rotation substantially coincident with the axis of rotation of the wash basket, means for detecting a condition indicative of imbalance of a load in the wash basket at low speeds of rotation, the method comprising the steps of accelerating the wash basket to first speed of rotation, said first speed of rotation being below a resonant speed of the supported assembly of the washing machine and lower than a speed at which no wash load movements inside the wash basket occur, accelerating gradually from the first speed of rotation to a second speed of rotation, the second speed of rotation being higher than the first speed of rotation, the second speed of rotation being sufficiently high so as to prevent any movement of the wash load in the wash basket, and continuing the wash basket rotation at speeds equal to the second speed of rotation until movements of the wash load and the action of the automatic balancers impart a dynamic balancing condition which reduces the out-of-balance condition of the rotating wash basket below a predetermined level.

Yet another aspect of the present invention relates to a washing machine useful for reducing an out-of-balance condition thereof, the machine comprising a cabinet frame, an outer tub, springs and dampers resiliently supporting the outer tub in the cabinet frame, a wash basket rotatably positioned inside the outer tub and capable of rotating about an axis of rotation, two automatic balancers attached to the wash basket at each end of the wash basket, the automatic balancers having an axis of rotation substantially coincident with the axis of rotation of the wash basket, means for detecting a condition indicative of imbalance of a load in the wash basket at low speeds of rotation, and means for controlling the velocity of the wash basket including means for rotating the wash basket at different speeds of rotation about the axis of rotation, logic for accelerating the wash basket to first speed of rotation, said first speed of rotation being below a resonant speed of the supported assembly of the washing machine and lower than a speed at which no wash load movements inside the wash basket occur, logic for gradually accelerating from the first speed of rotation to a second speed of rotation, the second speed of rotation being higher than the first speed of rotation, the second speed of rotation being sufficiently high so as to prevent the movement of the wash load in the wash basket, and logic for continuing the wash basket rotation at speeds equal to the second speed of rotation until movements of the wash load and the action of the automatic balancers impart a dynamic balancing condition which reduces the out-of-balance condition of the rotating wash basket below a predetermined level.

Yet another aspect of the present invention relates to a rigid mode washing machine useful for reducing an out-of-balance condition thereof at low speeds of rotation, the machine comprising a cabinet frame, an outer tub rigidly mounted to the cabinet frame, a wash basket rotatably positioned inside the outer tub and capable of rotating about an axis of rotation, means for detecting a condition indicative of imbalance of a load in the wash basket at low speeds of rotation, and means for controlling the velocity of the wash basket including means for rotating the wash basket at different speeds of rotation about the axis of rotation, logic for accelerating the wash basket to first speed of rotation, said first speed of rotation being lower than a speed at which no wash load movements inside the wash basket occur, logic for gradually accelerating from the first speed of rotation to a second speed of rotation, the second speed of rotation being higher than the first speed of rotation, the second speed of rotation being sufficiently high so as to prevent the movement of the wash load in the wash basket under the condition of no imbalance, and logic for continuing the wash basket rotation at speeds equal to the second speed of rotation until movements of the wash load are no longer present and the out-of-balance condition of the rotating wash basket is below a predetermined level.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DETAILED DESCRIPTION OF PREFERRED EMBODIMENTS

Figure 1:
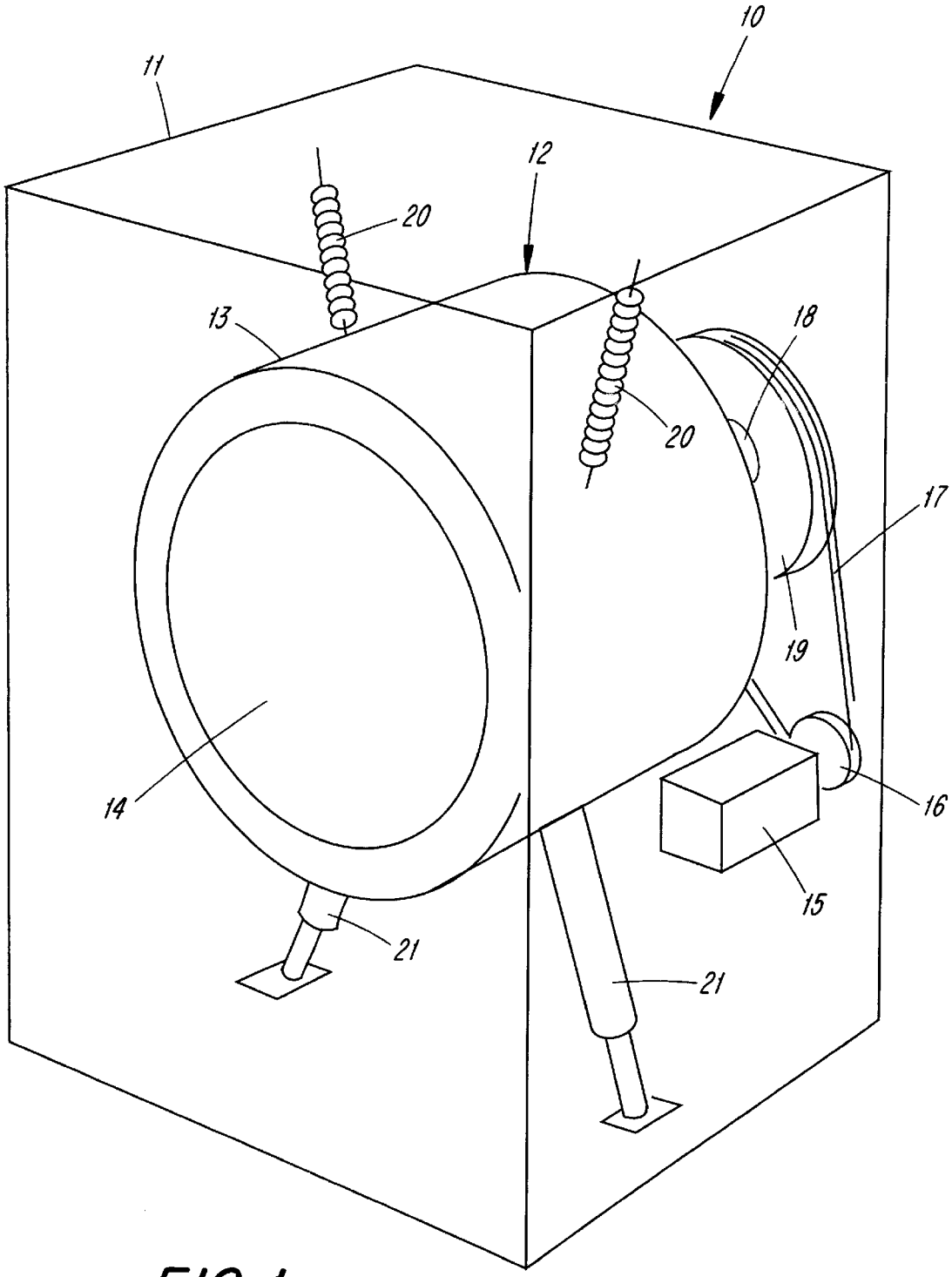
FIG. 1 illustrates an isometric view of a typical front loading horizontal axis domestic washing machine assembly or an industrial washer extractor, illustrating the general system to which the present invention applied.

The invention described herein is aimed at overcoming the deficiencies of the above prior art. An objective is to provide a reliable and effective method for pre-balancing (also known as low speed balancing) the wash baskets of domestic and industrial washing machines.

The present invention is aimed at overcoming the deficiencies in the existing prior art and is aimed at providing for reliable, repeatable, effective pre-balancing of wash baskets in domestic and industrial washing machines. Unlike the aforementioned documents which describe pre-balancing methods at speeds above the so-called stick-speed, the pre-balancing technique of the present invention is performed at a very low speed where the wash load in a washing machine is able to move during the wash tub rotation. A stick-speed as used herein is defined as a rotating speed of the wash basket which, when held constant, is sufficiently high to ensure that the entire wash load adheres to the wash basket during the entire pre-balancing process, yet is still below the first resonant speed of the entire suspended assembly.

The movement of the wash load during the pre-balancing action reduces the initial wash load imbalance. Consequently, a number of beneficial effects result, among which are: (1) the remainder of the pre-balancing process is carried out with substantially the same amount of imbalance from run to run thus making the process more reliable and avoiding unforeseen occurrences of very large imbalances; (2) the detrimental movement of the entire suspended assembly is minimized during the pre-balancing action; (3) the time of pre-balancing is shortened considerably since the wash load is partially redistributed by the tumbling motion, which avoids the onset of detrimental dynamic imbalances.

The basic structure to which the present invention relates provides for some or all of the following:

A horizontal axis washing machine including a cabinet frame, an outer water retaining tub resiliently suspended or supported from the cabinet frame by, e.g., springs and dampers, a wash basket positioned inside the outer tub and able to rotate about its axis or rotation, and a motor or other suitable device capable of rotating the wash basket at various speeds of rotation.

A pair of automatic balancers operably attached to the spin basket and placed at each end of the spin basket, the balancers' common axis of rotation being substantially coincident with the axis of rotation of the wash basket, each balancer including at least one annular race or a groove, a plurality of freely movable compensating masses disposed in each race, and a damping/lubricating fluid disposed in each race.

A detector for detecting the imbalance in the wash basket at low speeds of rotation, including, but not limited to, a sensor, detector, or measurement device(s) which is or are capable of measuring one, some, or all of the following: speed fluctuation measurement, motor torque measurements, and motor voltage and amperage measurement.

A device for estimating the stick speed for the given wash load conditions, including, but not limited to, a device which includes logic which executes an algorithm utilizing a measured or sensed input.

A motor controller capable of controlling the speed of rotation of the wash basket in accordance with pre-specified and preprogrammed algorithm.

The wash load movement during pre-balancing, in combination with the fluctuations in the speed caused by the imbalance, affects the movement of the compensating masses contained within automatic balancers. The combination of the movements of the wash load and the movements of the compensating masses within the automatic balancer greatly reduces the time required to reach an acceptable level of imbalance, with the residual imbalances being considerably lower than is the case with prior systems.

The present invention is at least in part based upon the ability to measure or sense the amount of imbalance and also the ability to accommodate a continuously changing imbalance in a washing machine. At low speeds, which are lower than the stick speeds (i.e., speeds where the wash load adheres to the inner surface of the wash basket throughout rotation), imbalance changes continuously because the wash load is not entirely stuck to the inside of the machine. Typically, the nature of a wash load is such that a filly or nearly fully balanced condition cannot be achieved strictly through wash load movements and an additional compensation is required. Such additional compensation is achieved with the automatic balancers.

Aspects of the present invention include:

providing a novel method of low speed pre-balancing of wash loads during slow speed rotation aimed at achieving a substantially balanced or nearly balanced condition for the spin basket to allow a smooth passage through resonant modes prior to reaching spin extraction phase;

providing a pre-balancing method which is effective, reliable, and repeatable under varying wash load and system conditions, wherein the balanced condition is achieved in a short period of time; and minimizing the onset and build-up of detrimental dynamic imbalances.

The present invention of pre-balancing wash baskets is based at least in part on effecting the movements of the wash loads within the wash baskets. The movements of the wash loads are utilized in the following manner:

Causing the average speed be slightly over the speed at which the wash load would adhere to the wash basket. If an imbalance is present, the speed will vary sinusoidally around the mean speed. When the point of effective imbalance (that is, the point on the wash basket where the excess wash load is positioned) is in an upward movement, the drum will slow down due to potential energy building up, reaching a speed at which the excess clothing can fall, thus shifting and changing the imbalance, or even eliminating the imbalance altogether. Allowing such limited movements of clothing inside the wash basket is important and extremely beneficial to an efficient pre-balancing process. The speed variations are monitored at all times, and when low speed fluctuations are sensed for the wash baskets, implying low levels of imbalance, the spin extraction cycle is initiated. This method ensures low levels of imbalance throughout the spin extraction cycle. The use of low speeds also increases the speed variations during the pre-balancing process, which increases effective forces on the compensating masses, in turn enabling them to assume a proper counter-balancing position.

Causing the average speed to be below the speed at which the laundry sticks to the drum. Thereafter, wait for a good condition and then ramp to above the stick speed and measure the actual imbalance. If the imbalance if found to be too high, decelerate to under the stick speed and repeat the process. This method represents a trial-and-error type gyration. It is not viewed to be as reliable as method (1), but it has an advantage of ease of implementation and a better cost-effectiveness.

An additional benefit from low speed pre-balancing can also be visualized by the following example. If the imbalance of the wash load and the compensating masses are at the same angular position relative to the wash basket, a maximum imbalance created. When such maximum imbalance is moving in an upward direction, the wash basket will slow down. The reduction in the speed of rotation of the wash basket will cause the wash load to break away from the surface of the wash basket. Consequently, the wash load will partially fall down while the compensating masses will continue their upward movement. A positional separation between the wash load and the compensating masses is thus achieved which further assists in the pre-balancing process.

The aspects of the present invention as described above, relate specifically to washing machines in which the outer tub-wash basket assembly is resiliently mounted inside the cabinet frame by means of springs and dampers. Those skilled in the art are well aware of the fact that such machines are well suited to the application and utilization of automatic balancers. However, it should be pointed out that the aspects of the present invention can also be applied to the so called rigid mode washing machines. Such machines are characterized the fact that the outer tub is rigidly mounted inside the cabinet frame. As a consequence, the resonant speeds are typically very high and are much higher than the spin speeds of the wash basket. Virbrations resulting from the wash load imbalance are particularly damaging on such systems. Furthermore, since the spin speeds are lower then the resonant speeds, automatic balancing is not possible on such machines. However, allowing for the limited movements of the wash load inside the wash basket in accordance with the present invention as described herein can still be used to pre-balance such machines at the low speeds of rotation, subsequently allowing for ramp-up to spin speeds without excessive damaging vibrations.

The following algorithms for achieving the desired low speed pre-balancing action are merely exemplary of algorithms in accordance with various embodiments of the present invention:

Algorithm 1

1. set speed to a value which is at a safe distance from the stick speed
2. measure the imbalance
3. if the imbalance is too high go to 5

4. Go to 14
5. if there is a SLOW decrease in unbalance go to 7
6. Go to 2.
7. reduce the speed by x rpm (0<x<10 rpm)
8. measure imbalance and possible laundry load movements
9. if laundry load movement is detected, record this speed as stick speed 1 and go to 11
10. record speed as stick speed 0, Go to 7
11. measure imbalance
12. if the imbalance level below an acceptable level, go to 14
13. Go to 11
14. ramp to spin-speed Algorithm 2

1. quickly ramp to a speed safely below the stick speed, i.e. 50 rpm
2. slowly ramp (e.g., 2 rpm/s) from a speed safely below stick speed.
3. sense wash load movements and imbalance during ramp-up
4. if imbalance is acceptable go to step 12
5. determine the stick speed and stop the ramp-up
6. set the average speed to a speed which is close to the stick speed ("close to" meaning a speed which is in the range of the average speed+/− speed variations; the speed variations due to imbalance will cause the drum, through one revolution, to also have a speed which is below the stick speed and therefore allow a small wash load movement)
7. measure the imbalance and the possible laundry movements
8. if the imbalance level is acceptable Go to 12
9. if there is laundry movement Go to 7
10. if the rate of imbalance change is below a predetermined level, reduce the speed by 1–2 rpm and then Go to 7
11. Go to 7
12. ramp to spin-speed Algorithms 1 and 2 can be implemented in any of numerous ways, as will be readily appreciated to those of skill in the art. Thus, while algorithms in accordance with the present invention can be incorporated into logic embodied in digital or analog form, hardware, firmware, or software, or controllers such as PLCs and the like, one aspect of the present invention implements is to implement the algorithm (s) in the firmware of the wash-control chip of the washing machine. Alternatively, some or all of the routines of the algorithm(s) can be implemented in separate chips and/or in the motorcontrol chip's firmware.

Further optionally, the algorithm(s) of the present invention can be implemented in software which is stored in memory and executed on a general purpose computer. For example, another embodiment of the present invention includes utilizing algorithms of the present invention to control a centrifuge. As will be readily appreciated by those of skill in the art, a centrifuge can be computer controlled through an interface to the computer, and thus the control algorithm is implemented in software which is executed by the computer. Similarly, large industrial centrifuges, sometimes utilized for chemical and food processing, can also be computer controlled and, thus, can include the algorithms of the present invention.

It should be understood the algorithms and their methods of implementation as described above and in accordance with the scope of present invention can be applied to achieve prebalancing of the so called rigid mode machines. It may also be noted that algorithm 1, algorithm 2, or a combination thereof can be used to provide prebalancing for the rigid mode machines.

The advantages of the present invention include, amongst many other advantages:

1) faster pre-balancing;
2) lower residual imbalance levels;
3) lower ramp-up displacements; and
4) reduced dynamic imbalance.

The novel features of the present invention, amongst other novel features, include:

1) Pre-balancing carried out below the stick speed of the rotating basket;
2) Utilization of wash load movements to enhance the pre-balancing process; and
3) Continuous monitoring of the speed of rotation of the wash basket in the pre-balancing process aimed at identifying the wash load movements or lack thereof, as well as the occurrences of balanced conditions suitable for ramp-up to spin extraction speeds.

Referring to FIG. 1, a general washing machine system to which the present invention relates is illustrated. The washing machine 10 includes a cabinet 11 and a suspended assembly 12 attached to the cabinet 11 by, e.g., suspension springs 20 and dampers 21. The suspended assembly 12 includes the non-rotating cylindrical outer tub 13, to which springs 20 and dampers 21 attach, and the rotating cylindrical inner wash basket 14 enclosed within the outer tub 13 and operably attached thereto and concentric therewith. Wash loads are disposed inside the wash basket. A pulley 19 is attached to the wash basket 14 through shaft 18 and is an exemplary device for imparting the rotating motion of the wash basket through belt 17. An electric motor 15 is suspended from the outer tub 13 and provides the torque required to rotate the wash basket 14 through the attached drive pulley 16 and belt 17. The wash basket 14 is usually made of perforated metal and provides for the tumbling action of the wash load during a wash cycle and water extraction during the spin cycle.

In operation, the dynamic response of the machine is defined by the mass and the moments of inertia of the suspended assembly 12, the characteristics of springs 20 and dampers 21, and their points of attachment on the outer tub 13 and the cabinet 11. It is well known to those skilled in the washing machine art that due to the inherent imbalance of the wash load, such dynamic response is characterized by the presence of resonances. Resonances are the conditions of greatly amplified and frequently intense levels of vibration of the suspended assembly, which occur at the so-called resonant speeds of rotation, or resonant frequencies. Resonant speeds of rotation depend on the particular mechanical properties of the machine, such as mass and mass distribution, spring and damper properties, machine cabinet stiffness, etc.

A typical washing machine has four main rigid body resonant speeds corresponding to four dominant rigid body modes: two so-called transverse modes and two so-called rotational modes. The transverse modes are considered to be induced by static imbalance and the rotational modes are induced by the dynamic imbalance in the wash basket. In a typical washing machine the aforementioned resonant speeds are greater than the tumbling speed during the wash cycle to afford adequate system rigidity, but significantly lower than the spin speeds in order to provide appropriate vibration isolation during water extraction phase. Therefore, for a typical washing machine, the spin basket must be accelerated through the resonances to reach the water extraction spin speeds. The present invention is aimed at minimizing the rigid body resonances as the machine accelerates to water extraction speeds by efficient and reliable pre-balancing of the wash basket to acceptable levels of static imbalance and by minimizing the levels of dynamic imbalance.

Figure 2:
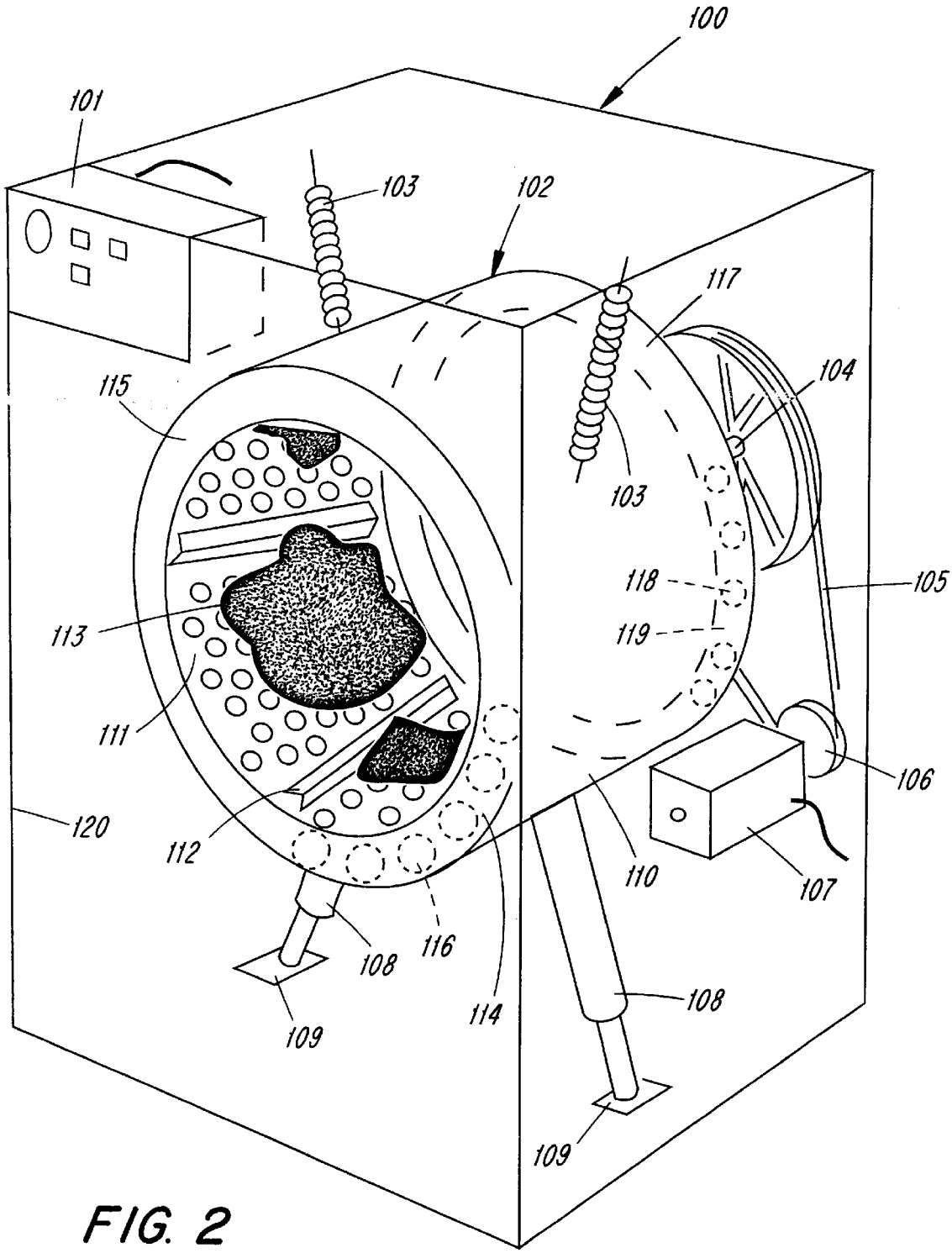
FIG. 2 illustrates an isometric view of a typical washing machine of FIG. 1 equipped with two automatic balancers operably attached to a wash basket at the front and rear planes thereof.

Referring to FIG. 2, a general washing machine system equipped with two automatic balancers is illustrated. The washing machine 100 includes a cabinet 120 and a suspended assembly 102 supported, e.g., by springs 103 and dampers 108. The suspended assembly 102 includes an outer tub 110 and the inner rotating wash basket 111. The wash load 113 is disposed inside the wash basket 111. Three circumferential disposed lifters 112 inside the wash basket 111 are used to impart a tumbling motion of the wash load 113 during the machine wash cycle. A control panel 101 contains the logic, e.g., electronic control, for various washing machine cycles, including the pre-balancing and spin cycles.

The control panel 101 can be digital or analog and is preferably connected to or integrated with a controller, e.g., one or more a digital chips which include logic embodying algorithms of the present invention. Currently available washing machines typically use small, one-chip computers for control of the washing machine. The program in these computers receive input from the control panel on variables such as the particular overall program (e.g., delicates, normal wash, with top spin=xxx rpm delayed yyy min, etc.). Sensory inputs to the controller typically include the speed of the machine, amount of water, etc. The outputs from the controller include motor setpoint, condition of valves controlling inflow and outflow of water, heat on/off, locking of the door, etc.

One aspect of the present invention is that the user of the washing machine does not control the prebalancing algorithm directly, although another aspect is that some or all of the variables for the present algorithms can be input by the user when implemented, e.g., in washing machines for which the user's skill is very high. As many washing machines typically include a separate controller (e.g., chip) for the control of the motor, there is a motor speed setpoint as an input to this motor controller. This motor speed setpoint is an output from the main computer of the machine. The present invention's prebalancing algorithm(s) can therefore be implemented in logic in a separate chip, in the main chip, or parts in both main and in the motor control chip.

A first balancing 115 unit is mounted concentrically to the wash basket 111 at the front plane. The first balancing unit 115 includes a hollow annular body with a first plurality of freely movable compensating masses 116 and a first damping fluid 114 disposed therein. A second balancing 117 unit is mounted concentrically to the wash basket 111 at the rear plane. The second balancing unit includes a hollow annular body with a second plurality of freely movable compensating masses 118 and a second damping fluid 119 disposed therein. The first plurality of compensating masses can be of different size and weight than the second plurality of compensating masses. Similarly, the first damping fluid can be of different viscosity than the second damping fluid.

The dampers 108 are attached to the outer tub and to the floor of the cabinet at locations 109. The damping action of the dampers 108 is suitably chosen, as will be readily apparent to those of skill in the art, to avoid excessive movements of the suspended assembly during the low speed pre-balancing which adversely affects the pre-balancing process. Such damping action depends on the number of dampers, dampers' properties, and the dampers' points of attachment to the cabinet and the outer tub. The damping action is selected so as to minimize the rigid body movements during the low speed rotation and prevent the onset of dynamic imbalance, but at the same time provide adequate vibration isolation at the spin extraction speeds from any residual imbalances that may exist.

Figure 3:
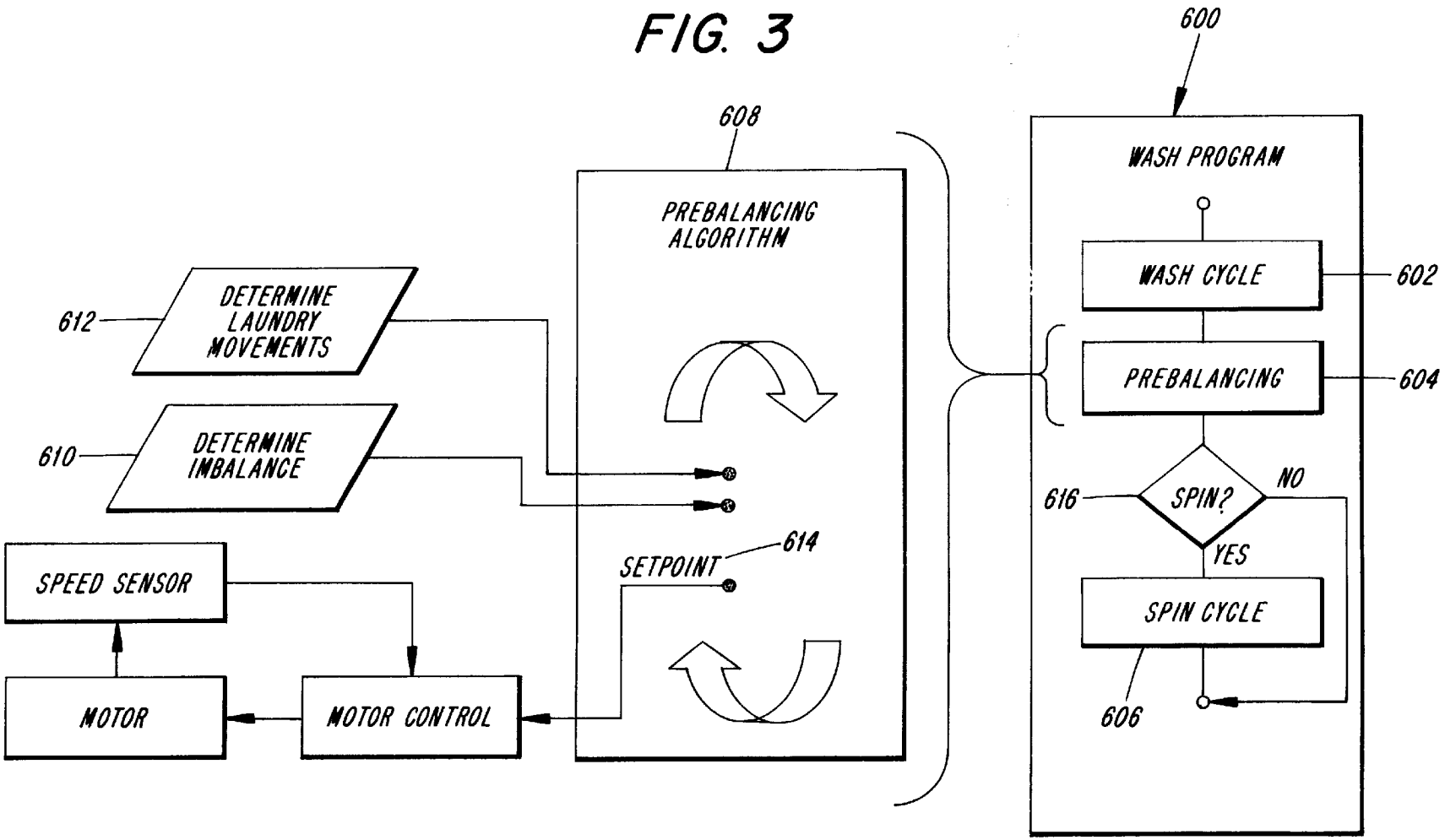
FIG. 3 illustrates an exemplary operating diagram of the washing machine system of FIG. 1 and FIG. 2 containing the pre-balancing segment in accordance with the present invention.

Referring now to FIG. 3, an exemplary basic wash program 600 for washing machines utilizing the present invention is illustrated. Such a wash program 600 includes, but is not limited to, a wash cycle 602, low speed pre-balancing cycle 604, and a water spin extraction cycle 606. The low speed pre-balancing cycle 604 is controlled by a pre-balancing algorithm 608 and involves sensing of wash basket imbalances 610 and determination of wash load movements 612. The measured or sensed information on imbalance 610 and wash load movements 612 is used to adjust the mean speed of rotation for the motor, and subsequently to initiate the ramp-up to the water spin extraction speeds. As discussed above, sensors or measurement devices usable in the present invention include, but are not limited to: drive motor voltage sensors; drive motor current sensors; drive motor torque sensors; and rotational speed sensors, which can be mechanical, electromechanical, magnetic, optical, or the like. The mean speed of rotation for the motor is set with a SETPOINT input 614, typically, although not necessarily, defined as a voltage (or torque) the magnitude of which is quasi-constant (i.e., is not adjusted to the instantaneous changes in speed of rotation, but rather changes in the average speed of rotation) and which is sufficient to overcome the frictional losses of rotation of the wash basket with the wash load. In cases where there are very large imbalances, the prebalancing algorithm 608 may not succeed in reaching an acceptable level of imbalance, at which decision point a decision 616 can be made not to proceed to the spin cycle 606.

Figure 4:
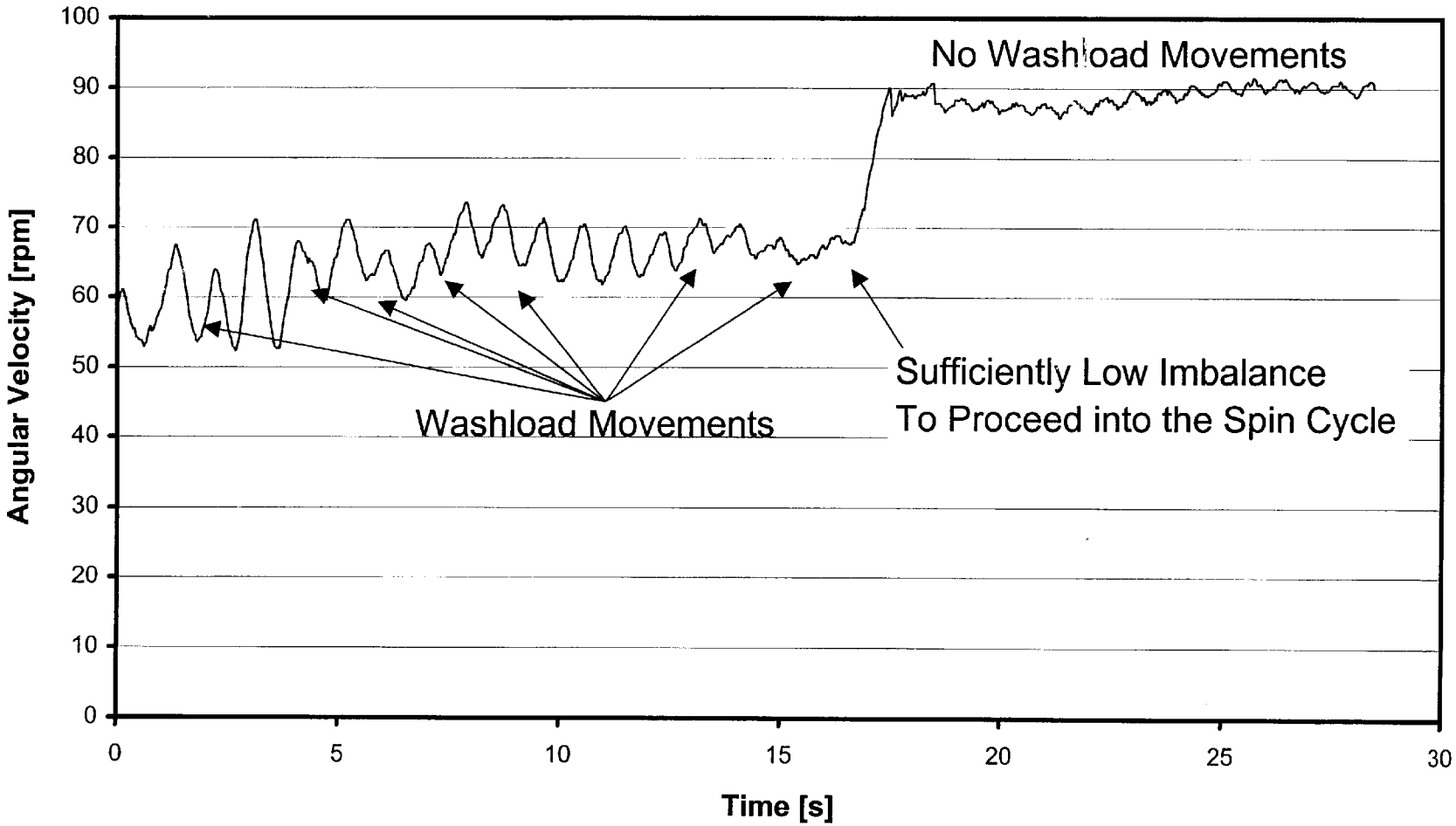
FIG. 4 illustrates a speed fluctuation—time history for a washing machine system utilizing the present invention showing a gradual reduction of imbalance during the pre-balancing process achieved through the combination of wash load movements and the balancing action of the attached automatic balancers.
Figure 5:
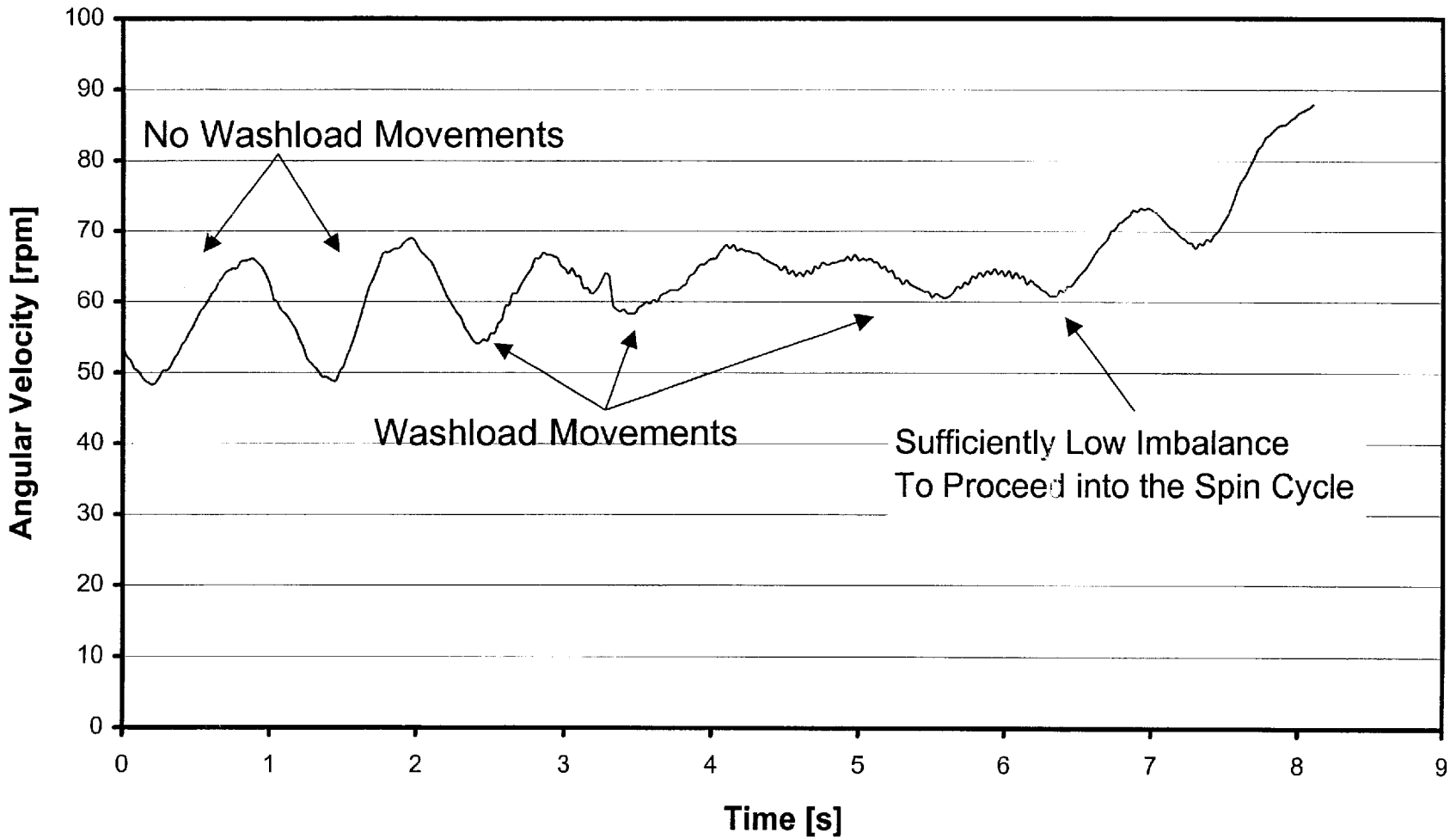
FIG. 5 illustrates the pre-balancing action of the present invention in a manner similar to that of FIG. 4, with different initial conditions and different setting for the mean speed of wash basket rotation.

Referring to FIGS. 4 and 5, an exemplary pre-balancing process is illustrated with reference to the fluctuation of the rotating speed of the wash basket. In the diagram the horizontal axis represents time and the vertical axis represents the instantaneous rotating speed of the wash basket. The pre-balancing cycle is started at time equal to zero. The wash basket accelerates to the appropriate mean or average pre-balancing rotating speed, which is slightly lower or slightly higher than the stick speed. The mean speed of rotation is defined by the time required to achieve one full revolution, regardless of changes in the instantaneous velocity. The stick speed refers to the constant rotating speed at which no wash load movement inside the wash basket would occur. Initially, large fluctuations of the rotating speed are present due to the presence of wash load imbalance. Since the SETPOINT input is quasi-constant, as the imbalance is rotated upward, the wash basket speed decreases. Similarly, as the imbalance descends, the rotating speed of the wash basket increases. Such increases and decreases from the average speed of rotation, which are referred to here as speed fluctuations, are greater for greater imbalances and smaller for smaller imbalances. Consequently, a perfectly balanced wash basket would exhibit no such fluctuations.

Further referring to FIGS. 4 and 5, upon a few revolutions the wash load movements start. Such wash load movements occur near the point where the effective imbalance is at or near the top position of rotation of the wash basket, as the instantaneous speed of rotation drops below the stick speed thus allowing the excess laundry at the point of imbalance to fall down to the bottom of the wash basket. Such wash load movements in combination with an additional balancing action from the attached automatic balancers, results in rapidly diminishing wash basket imbalances and corresponding diminishing fluctuations of the speed of rotation.

Once sufficiently low rotating speed fluctuations are sensed, signifying the acceptable levels of imbalance, the ramp-up to higher water extraction spin speeds is initiated.

Figure 6:
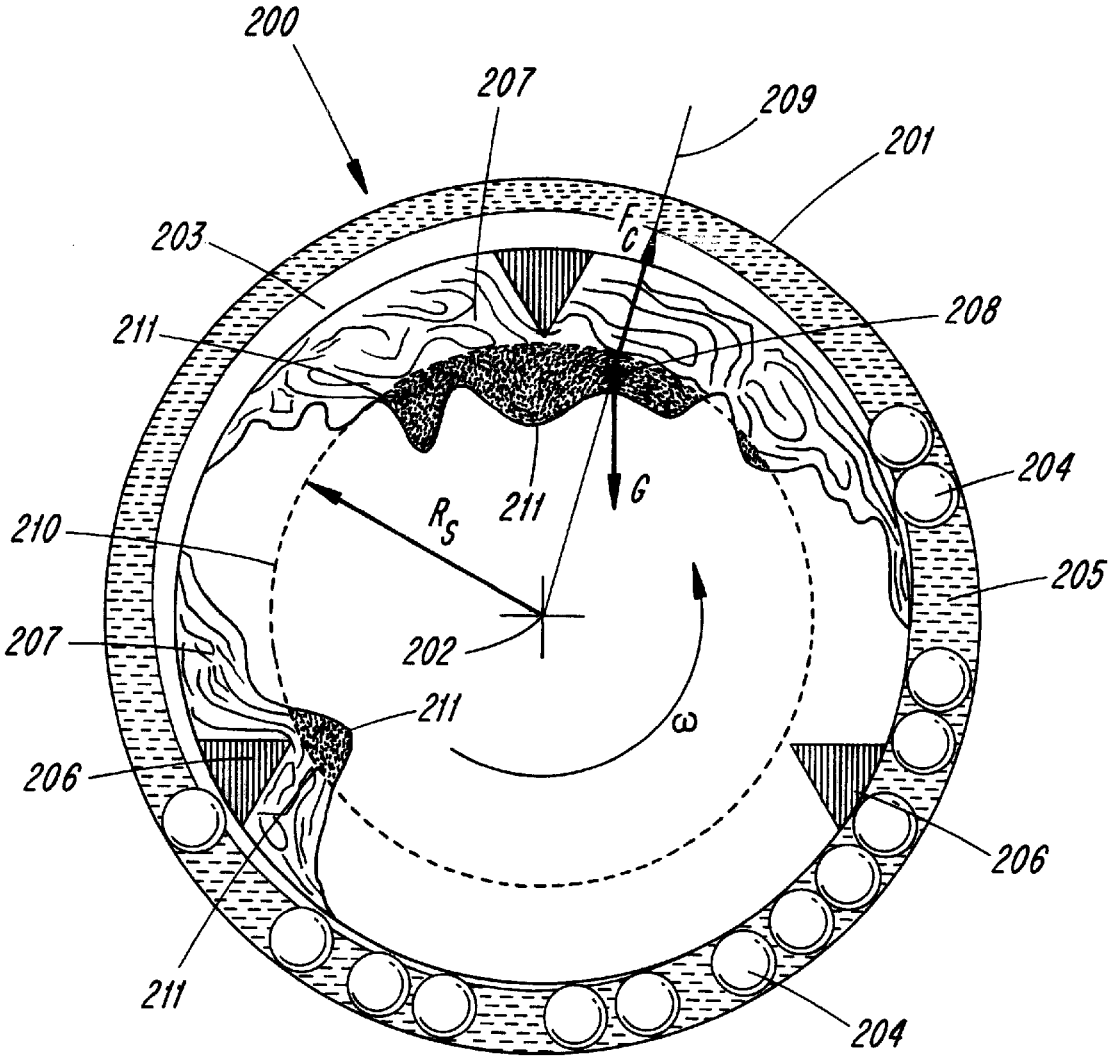
FIG. 6 illustrates the wash load movements and the pre-balancing process in accordance with the present invention, which relies on wash load movements and the additional balancing action of automatic balancers.

For greater clarity, referring to FIG. 6, a cross-sectional diagrammatic view of a wash basket assembly is shown. The wash basket assembly 200 includes a wash basket 201 containing lifters 206 and a concentric hollow annular groove 203 formed therein. A plurality of compensating masses 204 and the damping fluid 205 are disposed within the annular groove 203. The wash basket is readable about its axis of rotation 202. Wash load 207 is disposed inside the wash basket 201. For a wash basket rotating with a constant speed ω, the circle 210 defined by the radius $R_s$ represents the stick or adhesion limit. This circle is defined by the condition whereby the force of gravity G is equal to the centrifugal force $F_c$ for all masses 208. For areas outside that circle, the centrifugal force always exceeds the force of gravity and the wash load present therein adheres to the wash basket. For areas 211, which lie inside this circle, however, the gravity force exceeds the centrifugal force as such area moves towards the top position. Thereafter, a separation of wash load in such areas may occur which results in the aforementioned wash load movements. Such areas 211 of possible wash load separation from the rotating wash basket are illustrated in FIG. 6 as shaded areas. In a similar fashion, wash load movements occur during the pre-balancing process under the scope of the present invention. As the mass of effective imbalance travels upward, the rotating speed of the wash basket decreases. This effectively increases the radius of the stick-limit circle 210 and thus exposes more of the wash load areas for possible separation and movement.

Furthermore, as the separation occurs and the excess wash load falls to the bottom of the wash basket while the compensating masses are still proceeding in an upward direction, an improved counterbalancing condition is created whereby the compensating masses are opposite to the new imbalance position. This is particularly true for cases with high initial imbalance levels. Herein, the large initial imbalance causes a greater reduction in the rotating speed as the imbalances reaches the top position, which in turn, enables a larger portion of the wash load to separate from the wash basket, thus effectively changing the position of the imbalance inside the wash basket.

Figure 7:
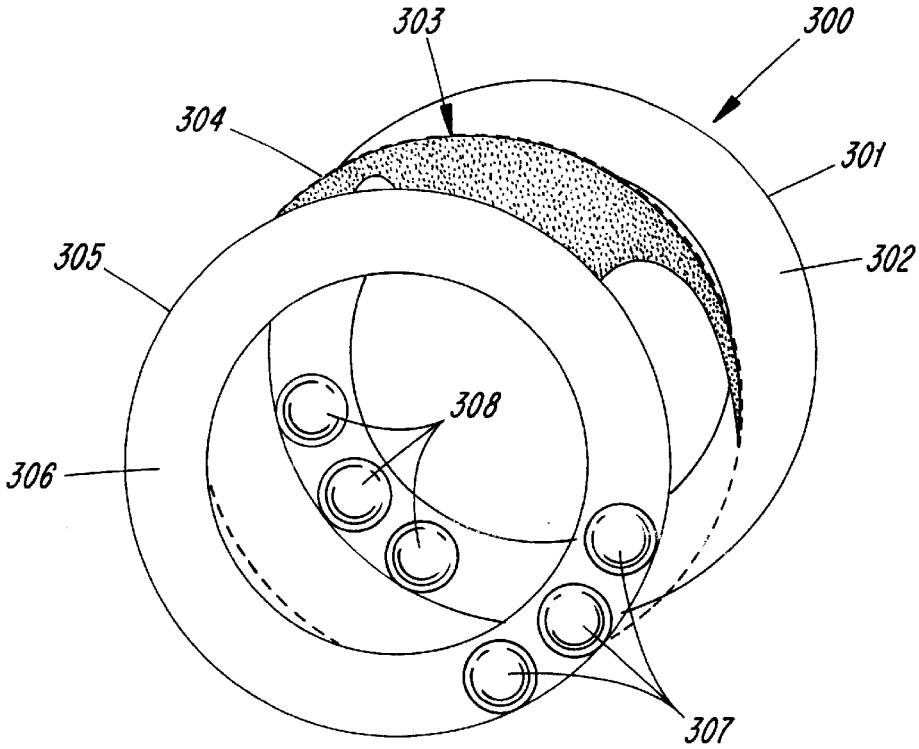
FIG. 7 illustrates a schematic isometric view of a wash basket equipped with two automatic balancing units illustrating the case of static balance and dynamic imbalance.

Referring to FIG. 7, a schematic isometric view of a wash basket with two balancers is illustrated. The wash basket 300 includes the first balancer 306 mounted at the front plane 305 and containing compensating masses 307. The second automatic balancer 302 is mounted in the rear plane 301 and contains compensating masses 308. The wash load 304 is located in the centre plane 303. The wash load 304 provides the initial imbalance in the wash basket. The compensating masses 307 of the front balancer 306 are located substantially opposite the effective imbalance. Similarly, the compensating masses 308 of the rear balancer 302 are located substantially opposite the imbalance. However, it is seen that there is a relative angular displacement between the two sets of compensating masses. This can give rise to the detrimental dynamic imbalances for the entire assembly.

Figure 8:
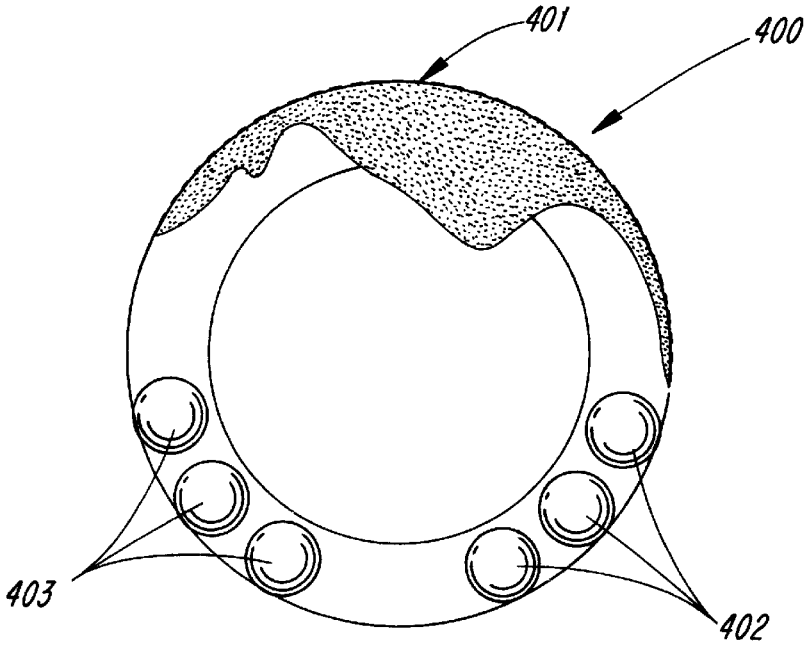
FIG. 8 illustrates a front diagrammatic view of a wash basket equipped with two automatic balancing units illustrating the case of static balance and dynamic imbalance.

For better clarity, referring to FIG. 8, a front sectional view of the assembly of FIG. 7 is shown. The compensating masses 402 of the from front balancer and the compensating masses 403 of the rear balancer substantially counterbalance the wash load imbalance 401. However, the two sets of compensating masses are opposite each other relative to the vertical line of symmetry. Although the compensating masses statically counterbalance the wash load imbalance, they effectively create a dynamic imbalance. It has been observed that for the pre-balancing performed under a 'fill stick' condition, such as for the prior art devices, dynamic imbalance situations such as those shown in FIGS. 7 and 8 often arise, in part due to long pre-balancing times. These dynamic imbalances tend to increase with lower wash load imbalances as greater angular separation between the two sets of compensating masses is afforded. Such dynamic imbalances tent to excite the rotational resonant modes, which may result in severe and damaging resonant vibrations.

Figure 9:
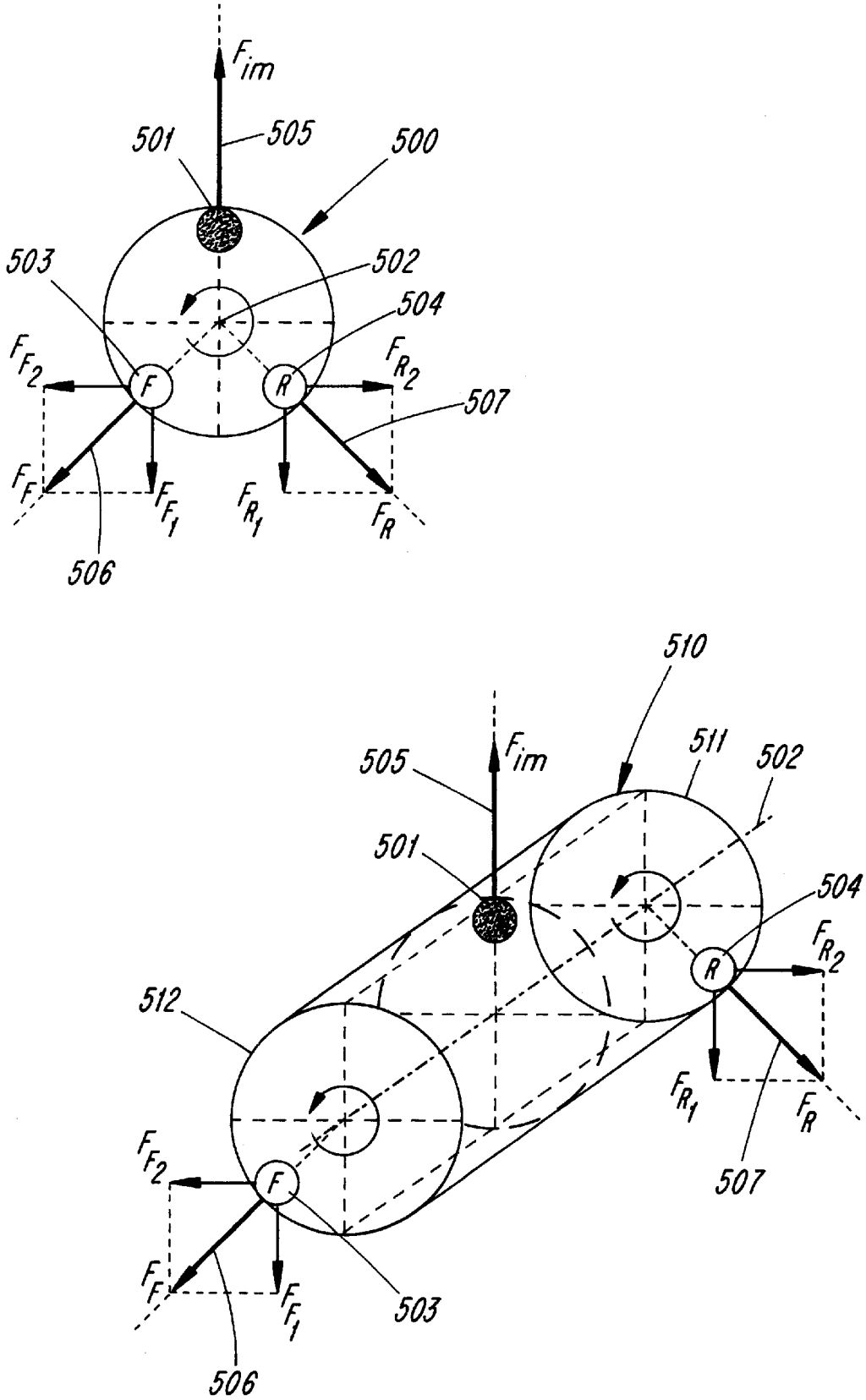
FIG. 9 illustrates a schematic representation of a wash basket equipped with two automatic balancing units of FIGS. 7 and 8, and illustrating the origin of the dynamic imbalance.

The force diagrams for the situation shown in FIGS. 7 and 8 are illustrated in FIG. 9. The effective wash load imbalance force $F_{im}$ is located at position 501 and is in the direction 505. The effective counterbalancing force from the front balancer $F_F$ is located at position 503 and is oriented along the direction 506. The effective counterbalancing force from the rear $F_R$ balancer is located at position 504 and is oriented along the direction 507. The component $F_{F1}$ of the front counterbalancing force $F_F$ and the component $F_{R1}$ of the rear counterbalancing force $F_R$ provide the required counterbalancing for the wash load imbalance $F_{im}$. However, the component $F_{F2}$ of the front counterbalancing force $F_F$ and the component $F_{R2}$ of the rear counterbalancing force $F_R$ result in an unbalanced couple yielding a dynamic imbalance condition.

The present invention which utilizes wash load movements during the pre-balancing action, minimizes the occurrences of balancer induced dynamic imbalances.

Figure 10:
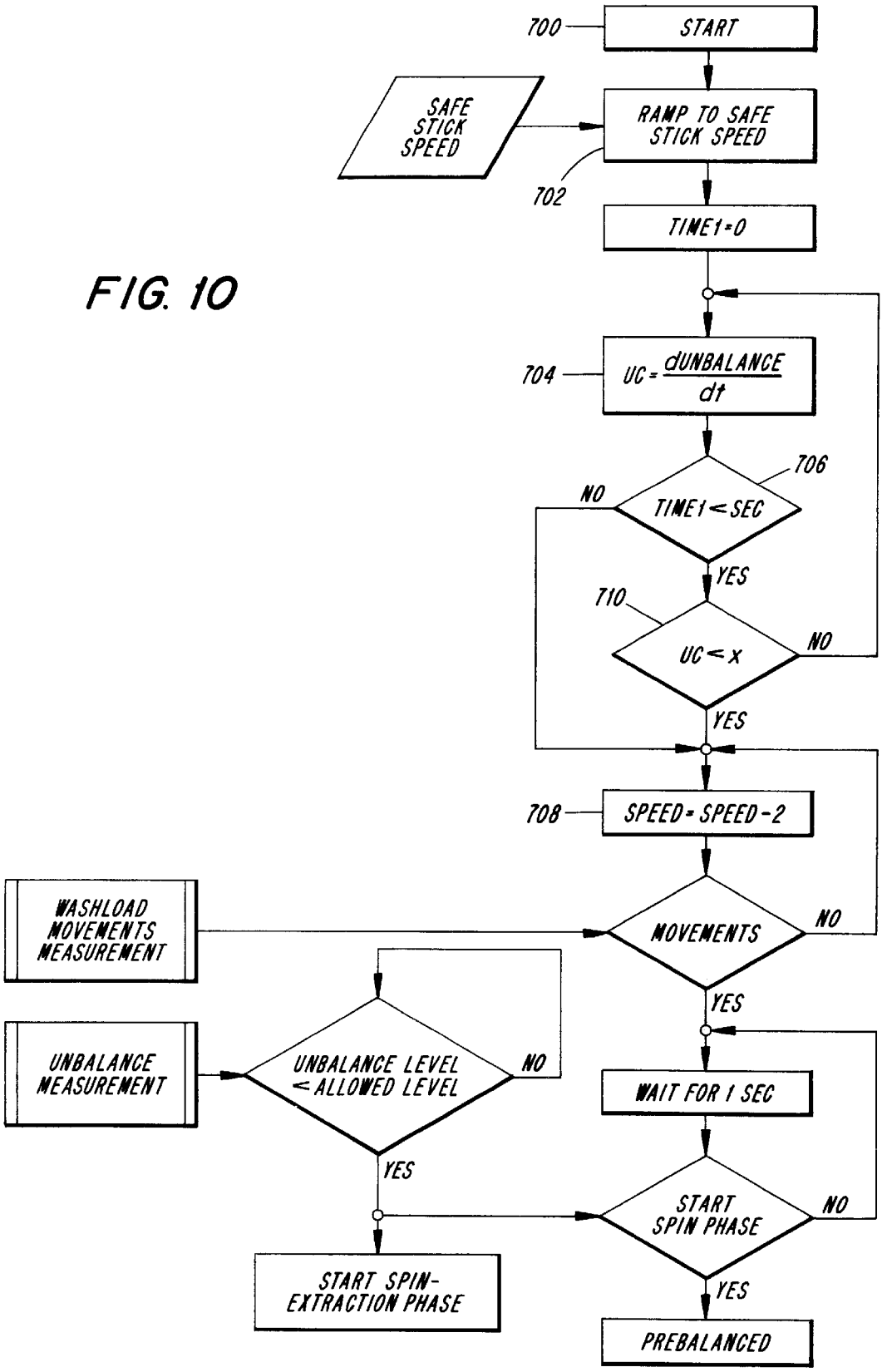
FIG. 10 illustrates a typical block and flow diagram of the pre-balancing segment referenced in FIG. 3 in accordance with the present invention.

Referring to FIG. 10, a preferred algorithm is illustrated. According to this algorithm, at the start 700 of the pre-balancing process, the wash basket is first accelerated to the initial pre-balancing speed (usually 50 rpm). Subsequently, a slow ramp-up 702 of the wash basket is carried out to reach speeds which are so-called safe stick speeds, i.e., the speeds where no laundry movement takes place. During the slow ramp-up, the imbalance is measured 704 continuously as is the rate of change of imbalance with time (UC). If, after the stick speed is reached, the residual imbalance is sufficiently low, the ramp-up to water extraction spin speeds is initiated.

The step of measuring the change of imbalance is performed because it has been found that large imbalances usually cause a high speed of prebalancing. For example, when the imbalance is high, the imbalance level will fall to a lower value, e.g., an initial 10 rpm variation can reduce to 1 rpm variation in 15 seconds (relatively high level of imbalance), compared with an initial a 5 rpm variation which can reduce to a 2 rpm variation in 20 seconds (relatively low level of imbalance).

Figure 12:
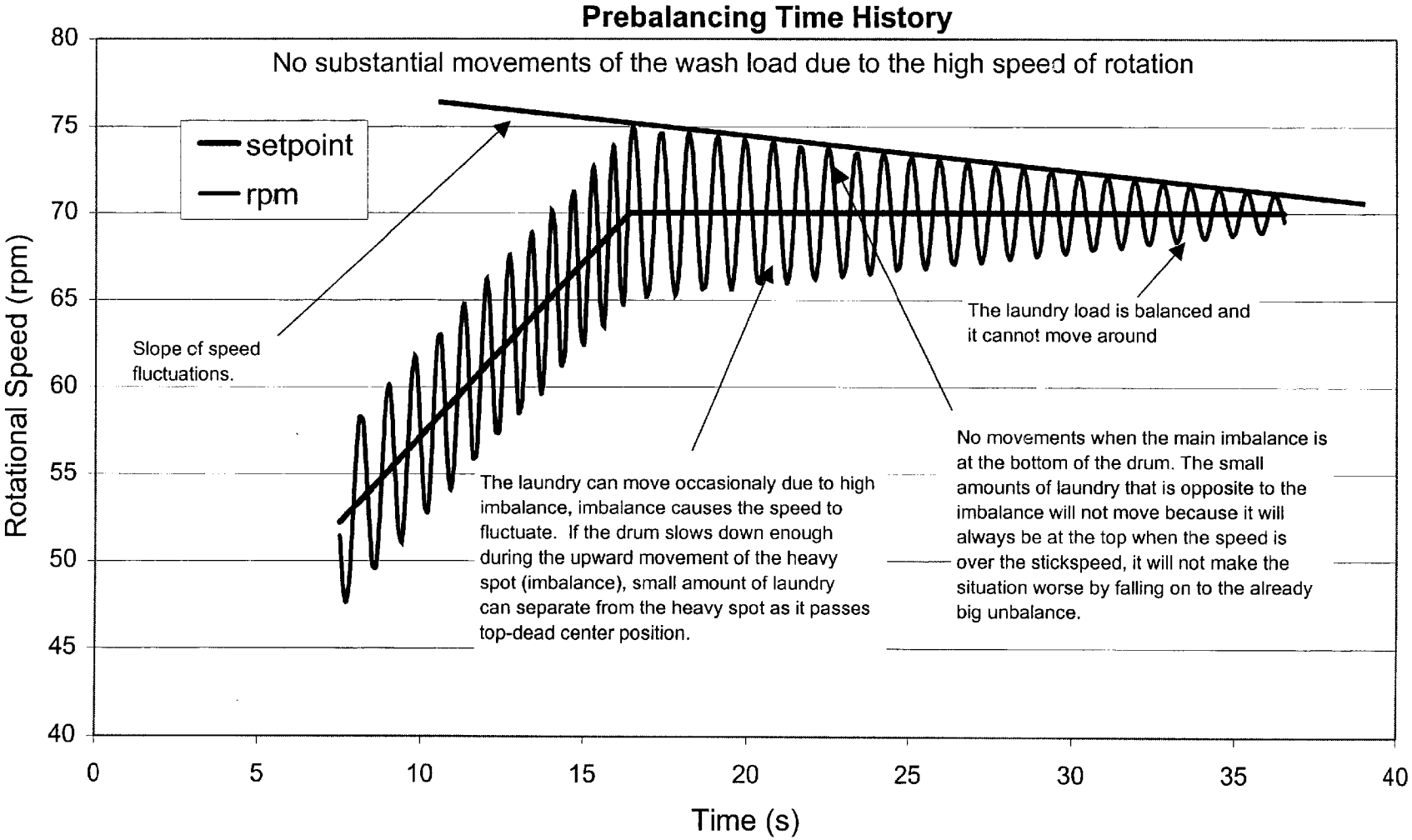

Without being limited to a particular theory, the presence of a large imbalance causes larger speed fluctuations of the drum during prebalancing, which in turn causes the automatic balancers, e.g. balls, to react more quickly, which in turn shows up as a large rate of imbalance reduction, i.e., high UC. It has been found that when the rate of imbalance reduction is high, a balanced position can be reached very quickly. This is desirable. If on the other hand, the rate of imbalance reduction is too low, long prebalancing times result leading to the undesirable dynamic imbalances. There exists a limiting value for the rate of reduction of imbalance referred herein to as $UC_{MIN}$. If the rate of imbalance reduction UC is lower than $UC_{MIN}$ the speed of rotation of the wash basket must be reduced so as to effect the movement of the laundry. It should also be noted that the rate of change of imbalance is proportional to the rate of change of speed fluctuations. Correspondingly, the condition for UC can be substituted by the condition for the rate of change of speed fluctuations as schematically illustrated in FIG. 12.

The actual value of $UC_{MIN}$ will differ from machine to machine and depends, at least in part, on the type of wash load and the amount of imbalance. It has been found, for example, that for a 5 kg domestic washing machine with a STIWA standard wash load, the rate of change of imbalance (UC) should be smaller greater than a level which would result in a balanced situation in less then 15–20 sec. Because imbalance causes speed fluctuation, and imbalance is reduced through the action of prebalancing, the speed fluctuation decreases. With a considerable imbalance, the initial speed fluctuation may be as high as +/−10 rpm.

The definition of 'sufficiently low' as used herein varies from application to application and is, in reality, determined by the end user. As will be readily appreciated by the skilled artisan, a situation to avoid, with reference to FIG. 1, is where the suspended assembly 12 hits the side of the cabinet during the ramp-up to the spin speed as it passes through the system resonant frequencies. Thus, one way to define a sufficiently low imbalance is one for which the suspended assembly 12 does not hit the cabinet 11 during run up. As will be readily apparent, such sufficiently low imbalance would depend on the mass of the suspended assembly 12, the properties of springs 20 and dampers 21, and the rotational acceleration during the run-up, which in turn define the response of the suspended assembly 12. Well-known mathematical models exist which predict the response of such a system, and as such will not be further described herein. One of skill in the art could use such theories and the knowledge of how much room exists inside the cabinet of his machine to determine a "safe" amount of imbalance inside the wash basket, which would result in the suspended assembly not hitting the cabinet during the run-up. Other measures for "sufficiently low" are also within the scope of the present invention.

If, at step 706, the residual imbalance is not sufficiently low upon reaching the safe stick speed, the wash basket rotation at the stick speed is maintained for a predetermined amount of time 'SEC'. If the levels of imbalance are still not sufficiently low upon expiration of this time interval, the speed is then gradually decreased at step 708 until the situation is achieved whereby the imbalance is sufficiently reduced. Also, if during the rotation at a safe-stick speed, the rate of change of imbalance with time (UC) is lower than some predetermined value (x), i.e., UC<x, (step 710) the speed is reduced. This cycle is repeated. This ensures a gradual and controlled pre-balancing action. Further explanation of this exemplary algorithm and the method of pre-balancing is given below, together with explanation of some of its main terms.

If the rate of change of imbalance UC, as sensed by the reduction in speed variations, is too slow, the prebalancing process is not proceeding quickly enough and the speed needs to be reduced and or the cycle repeated. This step of the process will differ depending on the type of laundry. Well known mathematical models and theories predict the dynamic response of the system and from this the reader can readily deduce what the rate of imbalance would be required to achieve prebalancing within any particular desired time. Furthermore, it is possible for example that when the rate of imbalance reduction is too slow, this may indicate that there may be large objects present in the wash basket which may not separate (tumble) at the preset speed which in turn, requires the reduction in speed.

A "safe stick speed", within the context of the present invention, is the velocity at which it is certain that there will be no movements of the laundry. The "safe stick speed" can be calculated or empirically determined in many different ways, and it can also be predetermined for each different washing machine model. The calculation can, for example, be performed from the following variables:

wash program amount of laundry, inertia, and mass drum diameter

If the value is predetermined for each washing machine model, the "safe stick speed" can be calculated from the drum diameter with the assumption that there will not be any laundry closer to the centre than an arbitrary distance, X mm.

Figure 14:
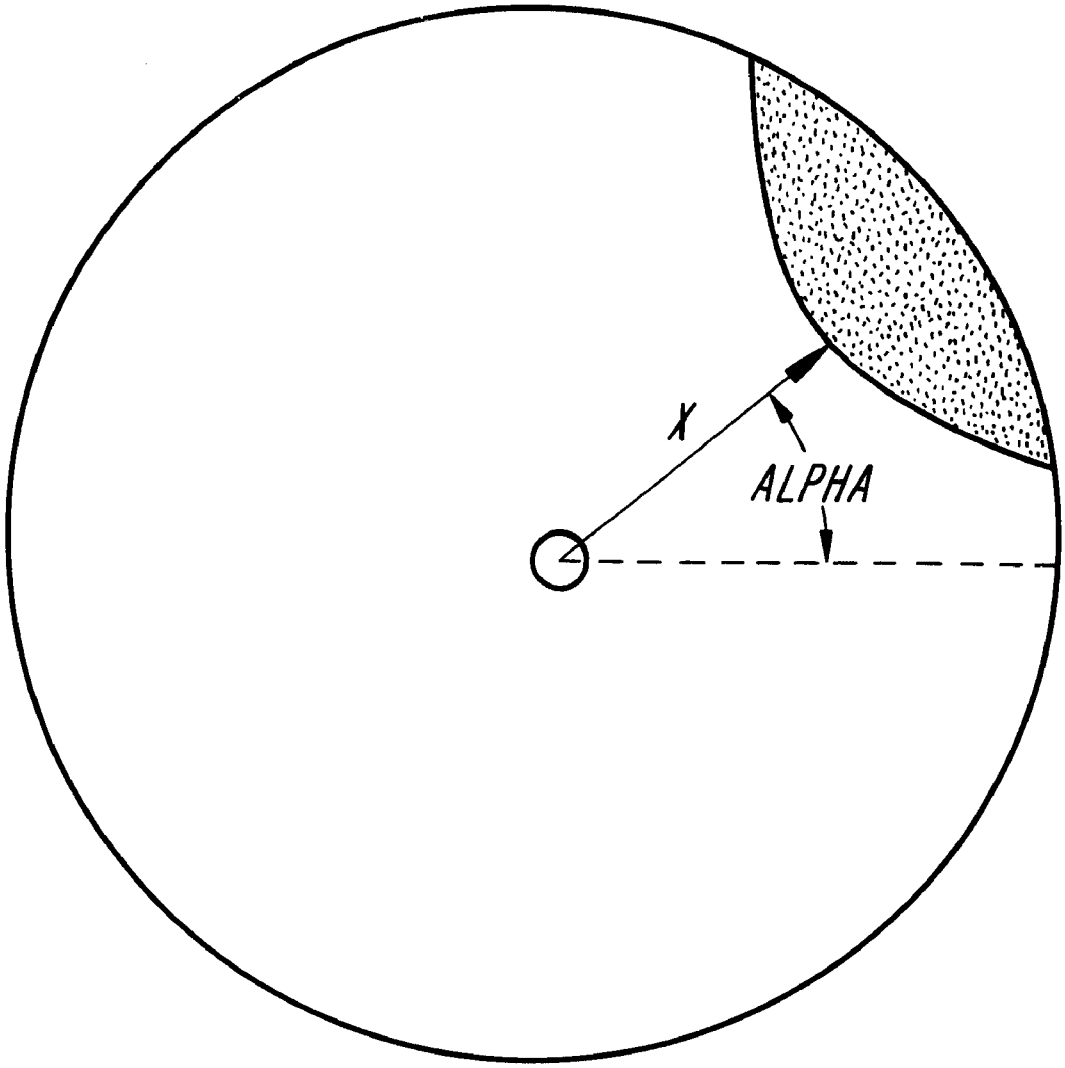
FIG. 14 illustrates a diagram useful in understanding the present invention.

Centrifugal forces acting on the laundry (see FIG. 14):

$$\omega = 2\pi\frac{rpm}{60}$$

$F_c = mX\omega^2$ $F_y = F_c \sin(\text{alfa}) \rightarrow F_y = mX\omega^2 \sin(\text{alfa})$ Gravity forces acting on the laundry:

$F_g = mg$

The extreme case is when the angle alfa=90 deg, at which there are no frictional forces between the drum and the laundry that can hold it, and in this position the effect of gravity is at a maximum.

$$F_y > F_g \rightarrow X\omega^2 > g$$

This means that a "safe stick speed" should be chosen above the "rpm" calculated above.

First, the basket velocity is ramped up to the "safe stick speed" where it is known that the laundry will not move. This ramp-up should be in a gentle manner, e.g., 1–2 rpm/s from, e.g., 50 rpm. With this ramp-up the laundry will be distributed slowly; this ramp speed is commonly used in washing machines for laundry distribution. When the ramp-up starts from 50 rpm the unbalance measurements preferably start.

Unbalance measurement: In certain algorithms of the present invention, for pre-balancing, there is a "unbalance measurement" that is run in parallel and is a part of the pre-balancing algorithm. The "unbalance measurement" continuously delivers the unbalance level value during the pre-balancing process.

The unbalance level can be calculated in many different ways. A useful way to do it is by looking at the speed-variations by simply calculating the RMS (root-mean-square) value of the speed. In connection with the "unbalance measurement", a checkpoint can be determined to which the "unbalance measurement" can be continuously compared. When the unbalance level gets below the allowed level, the spin-extraction phase should preferably begin.

When the first ramp-up is done the mean velocity of the drum is at "safe stick speed". At this speed a first attempt can be made to see if it is possible to reach an allowed level of unbalance in a short period of time. This is done by looking at the rate of change for the unbalance level, UC, i.e. the time derivative of the unbalance level. In this algorithm this is for a maximum time of "time 1"; if the "UC" is lower than a pre-set value the algorithm continuous to the next step which is to find a speed at which the laundry starts to move.

Wash load movements measurement: during pre-balancing there is a measured or calculated value that represents the amount of laundry movements which is constantly generated. The laundry movements can be calculated in many ways; one way is to look at the speed variations that do not have the same pattern as the speed variations that comes from the unbalance in the drum. The pattern of the speed variations generated from unbalance is nearly sinusoidal.

When the limit speed at which the laundry starts to move has been reached, it is preferably to wait for the unbalance level to get to the allowed level. There are alternative ways to go further, instead of just waiting for the unbalance level to go down, as in this exemplary algorithm. Further optionally, the speed can be increased if the laundry movements get too large, or even decrease the speed even more if it is found that the unbalance level does not change at a rate that is satisfying, i.e., below a predetermined threshold.

The present invention also includes alternatives at the beginning of the algorithm where, in this example, a ramp-up is done to the "safe stick speed". Instead of ramping up to this predetermined velocity it is also within the present invention to slowly ramp up and in the same time evaluate the "wash load movements measurement". When the measurement indicates non-movement, a velocity at which the laundry does not move is reached. From this point the algorithm continues with the above-mentioned adjustments of the velocity in such way that the drum is rotated at a velocity at which the laundry movement is kept to a minimum but still moving. If the laundry is allowed to move it will be assured that the counterweight balls and laundry will interact and thereby reach an allowed level of unbalance in a short time of period.

Figure 11:
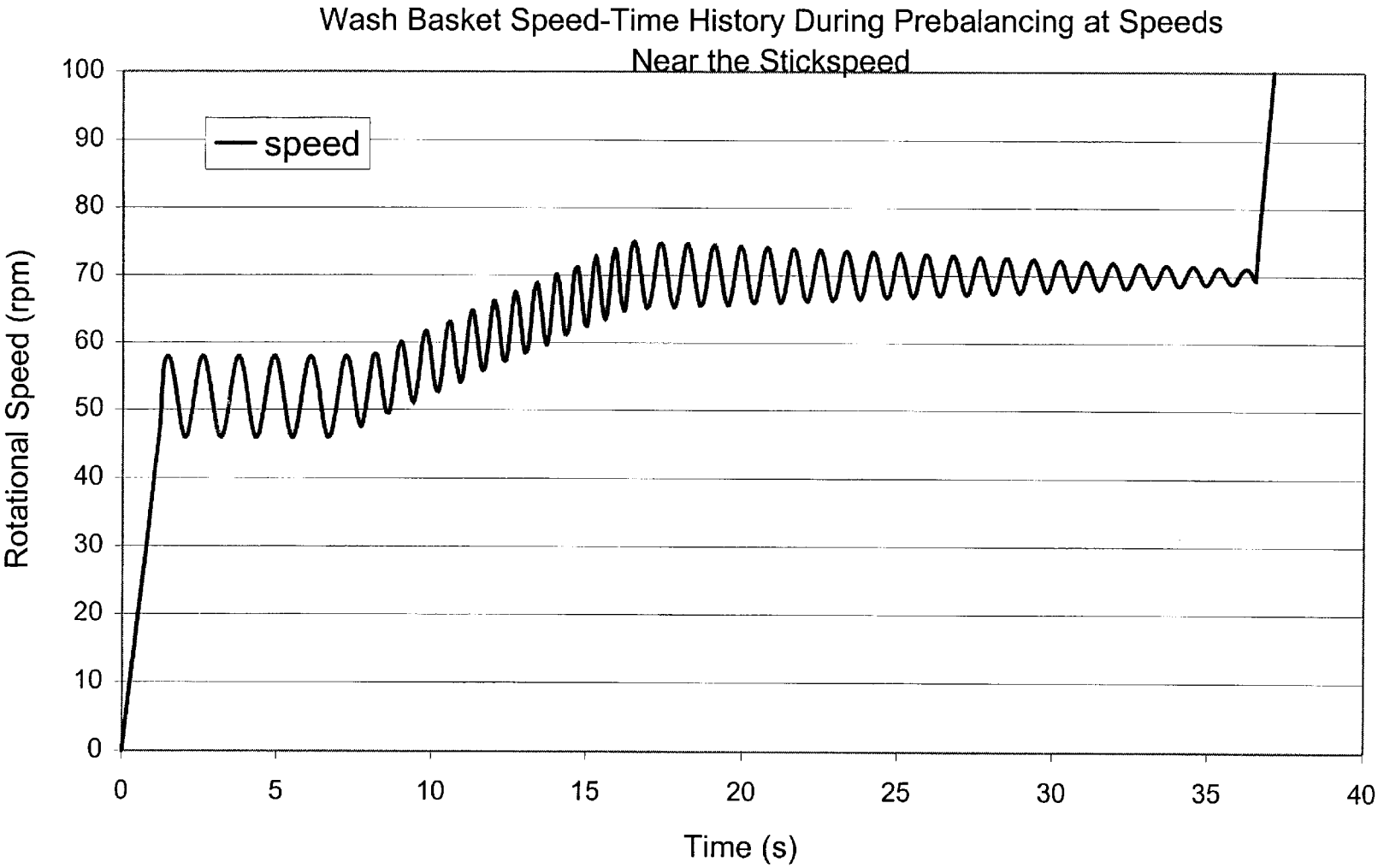
FIGS. 11, 12, and 13 illustrate schematic representations of the pre-balancing times for cases where any substantial wash load movement was not allowed during the process.
Figure 13:
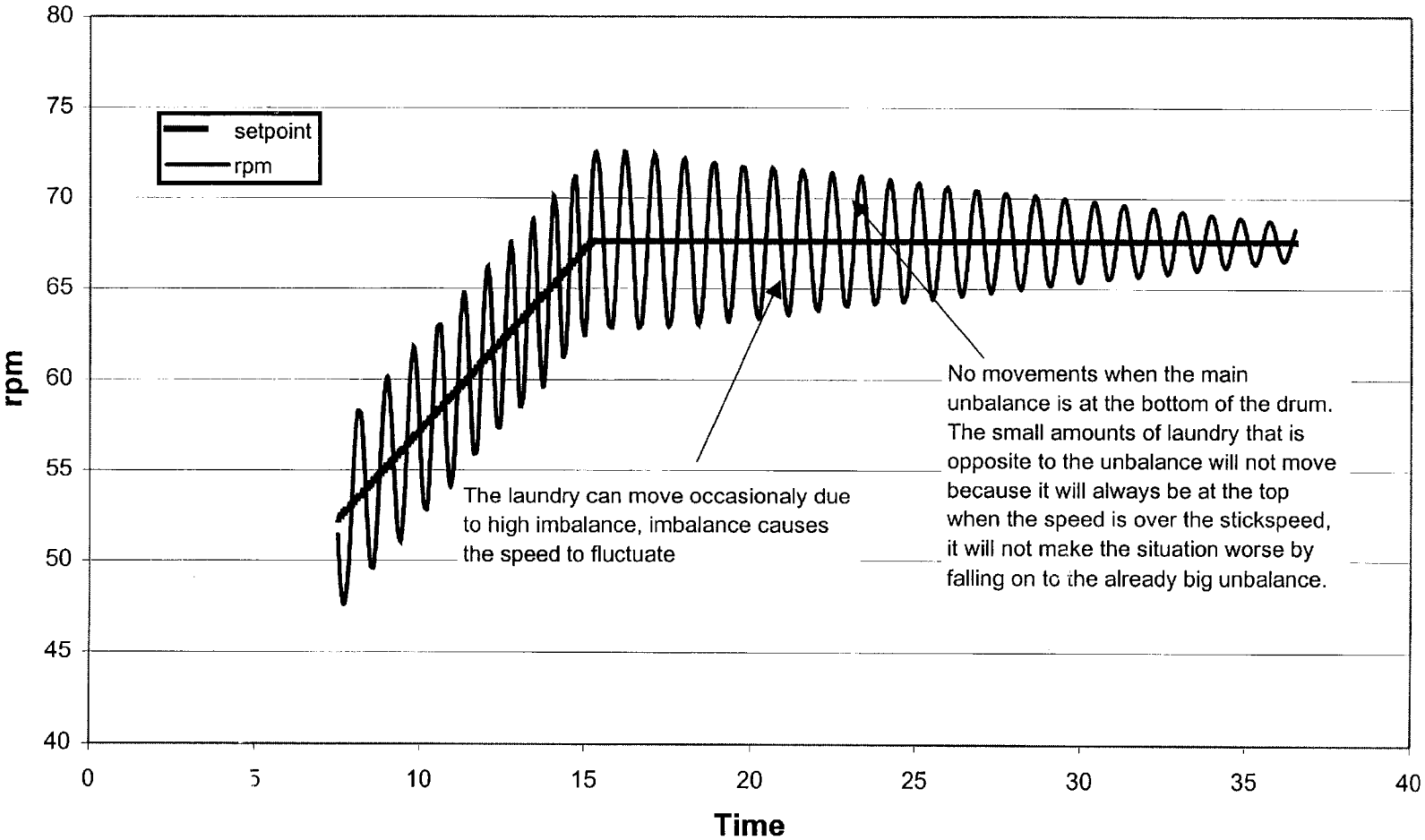

Referring further to FIGS. 11, 12, and 13, long pre-balancing times were observed experimentally for cases where wash load movement was not allowed during the process. FIG. 11 illustrates what happens with when laundry does not move at all; the speed of prebalancing is set to 70 rpm, which is relatively low.

FIGS. 12 and 13 illustrate prebalancing at a speed near the stick speed. FIG. 12 illustrates a situation were the prebalancing speed is set to a value slightly below the stick speed, and the laundry is allowed to move even when the machine is balanced. When the laundry is balanced it is unlikely that it will move around because a balanced laundry is more spread out and the inner clear radius $R_S$ is bigger, which leads to a lower effective speed at which there is no laundry movement.

In FIG. 13, the prebalancing speed is set to a value slightly over the safe stick speed, illustrating that it is not necessary to know the exact value of the speed at which the laundry does not move.

It should be appreciated that various alternatives and modifications of the above disclosed method and apparatus may be performed in order to meet the objectives of the invention. For example some variations may include, but is not limited to:

Skipping the balancers and pre-balance the wash load with the same algorithm

Pre-balancing is usable on other applications where there is a shifting unbalance.

It is possible to lower the stick speed if, first, a relatively high speed (e.g., 130–140 rpm) is achieved for de-watering the laundry load, which also lowers the unbalance and makes the wash load compact which reduces the effective radius at which the laundry is revolving, resulting in a lower stick speed; then go down to the new stick speed (monitored or just a constant depending on measurables like water content, amount of laundry, wash program etc). At this lower stick speed it is possible to pre-balance the laundry much quicker.

Measure the main unbalance position with the speed variation (and/or with other kind of measurables, like torque). Then, use a strong motor and force a periodic speed profile that drives the balls to a balanced position, with a maximum speed when unbalance in the bottom.

The present invention can be applied to any system where the axis of rotation is horizontal or substantially horizontal and where it is important or desirable to avoid excessive run-up vibrations. Such systems include, for example, large industrial washers, centrifuges, spin rinse dryers (used for drying of silicon wafers and other sensitive electronic components), industrial centrifuges in chemical process and food processing industry, and the like.

While the invention has been described in detail with reference to preferred embodiments thereof, it will be apparent to one skilled in the art that various changes can be made, and equivalents employed, without departing from the scope of the invention. Each of the aforementioned published documents is incorporated by reference herein in its entirety.

What is claimed is:

1. A method for reducing an out-of-balance condition during low speed rotation of a wash basket of a laundry clothes washing machine, the machine including a cabinet frame, an outer tub, springs and dampers resiliently supporting the outer tub in the cabinet frame, the wash basket rotatably positioned inside the outer tub and capable of rotating about an axis of rotation, and means for rotating the wash basket at different speeds of rotation about the axis of rotation, two automatic balancers attached to the wash basket at each end of the wash basket, the automatic balancers having an axis of rotation substantially coincident with the axis of rotation of the wash basket, means for detecting a condition indicative of imbalance of a load in the wash basket at low speeds of rotation, the method comprising the steps of:

accelerating the wash basket to a first speed of rotation, said first speed of rotation being below a resonant speed of a supported assembly of the washing machine and higher than a speed at which any wash load movements inside the wash basket occur;

decelerating from the first speed of rotation to a second speed of rotation, the second speed of rotation being lower than the first speed of rotation, the second speed of rotation being sufficiently low to initiate the movement of the wash load in the wash basket;

continuing the wash basket rotation at speeds lower than the second speed of rotation until movements of the wash load and action of the automatic balancers impart a dynamic balancing condition which reduces the out-of-balance condition of the rotating wash basket below a predetermined level.

2. A method in accordance with claim 1, further comprising spinning the wash basket at a velocity to extract water, and wherein the accelerating step is performed prior to the spinning water extraction step.

3. A method in accordance with claim 1, wherein each of the automatic balancers includes at least one annular race, a plurality of freely compensating masses disposed in each of at least one annular race, and a damping fluid in each race, and wherein, in the step of continuing the wash basket rotation at speeds lower than the second speed of rotation, the action of the automatic balancers comprises movement of the compensating masses.

4. A method in accordance with claim 1, wherein the machine comprises means for measuring wash load movement during low speed rotation including logic embodying an algorithm which operates on data from the means for detecting.

5. A method in accordance with claim 1, wherein the second speed is below a stick speed for the load.

6. A method in accordance with claim 1, wherein the machine includes a motor controller capable of controlling the motor to change the speed of rotation of the wash basket, and wherein the step of accelerating, the step of decelerating, or both, comprises operating the motor controller to change the velocity of the wash basket.

7. A washing machine useful for reducing an out-of-balance condition thereof, comprising:

a cabinet frame;

an outer tub;

springs and dampers resiliently supporting the outer tub in the cabinet frame;

a wash basket rotatably positioned inside the outer tub and capable of rotating about an axis of rotation;

two automatic balancers attached to the wash basket at each end of the wash basket, the automatic balancers having an axis of rotation substantially coincident with the axis of rotation of the wash basket;

means for detecting a condition indicative of imbalance of a load in the wash basket at low speeds of rotation;

means for controlling the velocity of the wash basket including:

means for rotating the wash basket at different speeds of rotation about the axis of rotation;

logic for accelerating the wash basket to a first speed of rotation, said first speed of rotation being below a resonant speed of a supported assembly of the washing machine and higher than a speed at which any wash load movements inside the wash basket occur;

logic for decelerating from the first speed of rotation to a second speed of rotation, the second speed of rotation being lower than the first speed of rotation, the second speed of rotation being sufficiently low to initiate the movement of the wash load in the wash basket; and logic for continuing the wash basket rotation at speeds lower than the second speed of rotation until movements of the wash load and the action of the automatic balancers impart a dynamic balancing condition which reduces the out-of-balance condition of the rotating wash basket below a predetermined level.

8. A machine in accordance with claim 7, further comprising:

logic for spinning the wash basket at a velocity to extract water; and logic for accelerating the wash basket prior to spinning.

9. A machine in accordance with claim 7, wherein each of the automatic balancers includes at least one annular race, a plurality of freely compensating masses disposed in each of at least one annular race, and a damping fluid in each race.

10. A machine in accordance with claim 7, wherein the machine comprises means for measuring wash load movement during low speed rotation including logic embodying an algorithm which operates on data from the means for detecting.

11. A machine in accordance with claim 7, wherein the second speed is below a stick speed for the load.

12. A machine in accordance with claim 7, wherein the machine includes a motor controller capable of controlling the motor to change the speed of rotation of the wash basket, and wherein the accelerating logic, the decelerating logic, or both, comprises logic for operating the motor controller to change the velocity of the wash basket.

13. A method for reducing an out-of-balance condition during low speed rotation of a wash basket of a laundry clothes washing machine, the machine including a cabinet frame, an outer tub, springs and dampers resiliently supporting the outer tub in the cabinet frame, a wash basket rotatably positioned inside the outer tub and capable of rotating about an axis of rotation, and means for rotating the wash basket at different speeds of rotation about the axis of rotation, two automatic balancers attached to the wash basket at each end of the wash basket, the automatic balancers having an axis of rotation substantially coincident with the axis of rotation of the wash basket, means for detecting a condition indicative of imbalance of a load in the wash basket at low speeds of rotation, the method comprising the steps of:

accelerating the wash basket to first speed of rotation, said first speed of rotation being below a resonant speed of a supported assembly of the washing machine and lower than a speed at which no wash load movements inside the wash basket occur;

gradually accelerating from the first speed of rotation to a second speed of rotation, the second speed of rotation being greater than the first speed of rotation, the second speed of rotation being below a resonant speed of the supported assembly of the washing machine and lower than a speed at which no wash load movements inside the wash basket occur;

continuing the wash basket rotation at the second speed of rotation until movements of the wash load and the action of the automatic balancers impart a dynamic balancing condition which reduces the out-of-balance condition of the rotating wash basket below a predetermined level.

14. A method in accordance with claim 13, further comprising spinning the wash basket at a velocity to extract water, and wherein the accelerating step is performed prior to the spinning water extraction step.

15. A method in accordance with claim 13, wherein each of the automatic balancers includes at least one annular race, a plurality of freely compensating masses disposed in each of at least one annular race, and a damping fluid in each race, and wherein, in the step of continuing the wash basket rotation at the second speed of rotation, the action of the automatic balancers comprises movement of the compensating masses.

16. A method in accordance with claim 13, further comprising decelerating from the second speed of rotation to a third speed of rotation of the wash basket, said third speed of rotation being lower then the second speed of rotation, said third speed of rotation being greater than the first speed of rotation, and wherein the decelerating step is performed prior to the spinning water extraction step.

17. A method in accordance with claim 16, wherein the machine includes a motor controller capable of controlling the motor to change the speed of rotation of the wash basket, and wherein the step of accelerating, the step of decelerating, or both, comprises operating the motor controller to change the velocity of the wash basket.

18. A method in accordance with claim 13, wherein the machine comprises means for measuring wash load movement during low speed rotation including logic embodying an algorithm which operates on data from the means for detecting.

19. A method in accordance with claim 13, wherein the second speed is below a stick speed for the load.

20. A method in accordance with claim 13, wherein the second speed is above a stick speed for the load.

21. A method in accordance with claim 13, wherein the machine includes a motor controller capable of controlling the motor to change the speed of rotation of the wash basket, and wherein the step of accelerating comprises operating the motor controller to change the velocity of the wash basket.

22. A method for reducing an out-of-balance condition during low speed rotation of a wash basket of a laundry clothes washing machine, the machine including a cabinet frame, an outer tub, a cabinet frame rigidly supporting the outer tub, a wash basket rotatably positioned inside the outer tub and capable of rotating about an axis of rotation, and means for rotating the wash basket at different speeds of rotation about the axis of rotation, means for detecting a condition indicative of imbalance of a load in the wash basket at low speeds of rotation, the method comprising the steps of:

accelerating the wash basket to a first speed of rotation, said first speed of rotation being lower than a speed at which no wash load movements inside the wash basket occur;

gradually accelerating from the first speed of rotation to a second speed of rotation, the second speed of rotation being greater than the first speed of rotation, the second speed of rotation being lower than a speed at which no wash load movements inside the wash basket occur;

continuing the wash basket rotation at the second speed of rotation until movements of the wash load impart a dynamic balancing condition which reduces the out-of-balance condition of the rotating wash basket to a level below a predetermined value.

* * * * *